US009532617B2

(12) United States Patent
Miller et al.

(10) Patent No.: US 9,532,617 B2
(45) Date of Patent: Jan. 3, 2017

(54) DISPOSABLE FACE SHIELD

(71) Applicant: TIDI Products, LLC, Neenah, WI (US)

(72) Inventors: Kurt Miller, Neenah, WI (US); Brian L. Wilt, Appleton, WI (US)

(73) Assignee: TIDI Products, LLC, Neenah, WI (US)

( * ) Notice: Subject to any disclaimer, the term of this patent is extended or adjusted under 35 U.S.C. 154(b) by 200 days.

(21) Appl. No.: 14/269,625

(22) Filed: May 5, 2014

(65) Prior Publication Data

US 2015/0237931 A1 Aug. 27, 2015

Related U.S. Application Data

(63) Continuation-in-part of application No. 29/482,840, filed on Feb. 21, 2014, now Pat. No. Des. 732,242.

(51) Int. Cl.
*A41D 13/11* (2006.01)

(52) U.S. Cl.
CPC ..... *A41D 13/1184* (2013.01); *A41D 2400/52* (2013.01)

(58) Field of Classification Search
CPC ..... A42B 1/06; A42B 1/00; A61F 9/04
USPC . 2/9, 455, 410, 426, 427, 425, 424; D2/100, 102–110, 122
See application file for complete search history.

(56) References Cited

U.S. PATENT DOCUMENTS 797,293 A 8/1905 Lang et al.
1,337,036 A 4/1920 Bergmann
2,233,698 A 3/1941 Girouard
2,342,982 A 2/1944 Stern at al.
2,620,472 A 12/1952 Sors et al.
2,758,307 A 8/1956 Treiber
2,774,970 A 12/1956 Rudolf
2,798,222 A 7/1957 Evans et al.
2,829,374 A 4/1958 Malcom, Jr.
2,866,202 A 12/1958 Landis
2,963,708 A 12/1960 Herbine et al.
3,041,624 A 7/1962 Cutrona, Jr,
D206,620 S 1/1967 Hoffman
3,295,143 A 1/1967 Hoffman
D210,002 S 1/1968 Zahn
3,369,255 A 2/1968 Seraphin
3,380,073 A 4/1968 Mclaughlin
3,383,155 A 5/1968 Bourke
3,383,707 A 5/1968 McNeill
3,517,392 A 6/1970 Hodge et al.
(Continued)

FOREIGN PATENT DOCUMENTS

KR 20000003265 2/2000
WO WO 8900844 2/1989
WO WO 2005026823 3/2005

*Primary Examiner* — Gloria Hale
(74) *Attorney, Agent, or Firm* — Boyle Fredrickson, S.C.

(57) ABSTRACT

A disposable face shield with a shield with a plurality of cuts is described. A foam member is connected to the shield to provide added comfort. The foam member may contain a plurality of openings extending through the member. The openings allow for increased air movement around the shield. The cuts in the shield may be above the foam member to create tabs which may be bent to at least partially cover the openings that extend through the foam member. Additionally, a pair of parallel cuts may be made on either side of the shield, the cuts adjustably engaging an elastic strap. This configuration allows the elastic strap to be comfortably adjusted to conform to a number of different sized heads.

17 Claims, 17 Drawing Sheets

(56) References Cited

U.S. PATENT DOCUMENTS 3,686,690 A 8/1972 Webb
D228,700 S 10/1973 Gager
3,787,113 A 1/1974 Shedrow
3,901,589 A 8/1975 Bienenfeld
4,190,333 A 2/1980 Lambert
4,391,498 A 7/1983 Rengstorff
4,451,127 A 5/1984 Moffitt, Jr.
4,523,819 A 6/1985 Dianitsch et al.
4,610,036 A 9/1986 Laprairie
4,741,611 A 5/1988 Burns
4,821,340 A 4/1989 Johnson
4,825,878 A 5/1989 Kuntz et al.
4,843,643 A 7/1989 Parissenti et al.
4,852,185 A 8/1989 Olson
4,852,186 A 8/1989 Landis
4,853,974 A 8/1989 Olim
4,864,653 A 9/1989 Landis
4,867,178 A 9/1989 Smith
4,868,930 A 9/1989 Blackstone
4,872,465 A 10/1989 Kuntz et al.
4,884,296 A * 12/1989 Nix, Jr. ..... A61F 9/02 2/11
4,884,302 A 12/1989 Foehl
D306,363 S 2/1990 Stackhouse et al.
4,920,576 A 5/1990 Landis
4,924,526 A 5/1990 Parissenti et al.
D308,582 S 6/1990 Salce et al.
4,944,039 A 7/1990 Dietrich
4,944,312 A * 7/1990 Smith ..... A41D 13/1161 128/207.11
4,945,573 A 8/1990 Landis
4,945,574 A 8/1990 Dagher
D311,262 S 10/1990 Curry
D311,782 S 10/1990 Salce et al.
D311,978 S 11/1990 Metcalfe
D312,331 S 11/1990 Poettgen
4,986,282 A 1/1991 Stackhouse et al.
D318,147 S 7/1991 Russell
D321,067 S 10/1991 Salce et al.
D321,268 S * 10/1991 Nix, Jr. ..... D29/110
D321,958 S 11/1991 Salce et al.
5,088,114 A 2/1992 Salce et al.
5,113,528 A * 5/1992 Burke, Jr. ..... A61F 9/02 128/857
5,113,529 A 5/1992 Carr
D326,932 S 6/1992 Millar
5,129,102 A 7/1992 Solo
5,170,502 A 12/1992 Hegendorfer et al.
D335,723 S 5/1993 Pawliszyn
5,206,956 A 5/1993 Olson
5,243,711 A 9/1993 Graham
5,297,298 A 3/1994 Salatka et al.
5,303,423 A 4/1994 Gazzara et al.
D347,909 S * 6/1994 Gazzara ..... D29/110
D349,177 S 7/1994 Russell
D349,178 S 7/1994 Russell
D349,362 S 8/1994 Russell
5,337,419 A 8/1994 Russell
D354,588 S 1/1995 Russell
D354,589 S 1/1995 Russell
5,402,552 A 4/1995 Chen
D358,684 S 5/1995 Salce
5,416,923 A 5/1995 Peugh
D361,160 S 8/1995 Russell
5,440,760 A 8/1995 Highsmith
D362,086 S 9/1995 Russell
5,446,925 A 9/1995 Baker et al.
5,469,229 A 11/1995 Greenbaum
5,471,679 A 12/1995 Paoluccio
D366,540 S 1/1996 Elias
5,500,694 A 3/1996 Roever et al.
5,519,896 A 5/1996 Ford
D374,951 S 10/1996 Machsom
D375,583 S 11/1996 Landis et al.
5,576,776 A 11/1996 Scheller
5,584,078 A 12/1996 Saboory
5,600,870 A 2/1997 Fields et al.
5,638,145 A 6/1997 Jannard
5,652,954 A 8/1997 Paiement
5,666,664 A 9/1997 Hamilton
5,692,522 A 12/1997 Landis
5,694,925 A 12/1997 Reese et al.
5,699,792 A 12/1997 Reese et al.
5,704,349 A 1/1998 Hubbard et al.
5,765,223 A 6/1998 McCausland
5,815,235 A 9/1998 Runckel
D404,848 S 1/1999 Banuchi
D404,849 S 1/1999 Desy
5,862,530 A 1/1999 Shillington
5,929,966 A 7/1999 Conner
5,956,117 A 9/1999 Suh et al.
5,956,760 A 9/1999 Wine et al.
5,970,514 A 10/1999 Wang-Lee
5,983,390 A * 11/1999 Desy ..... A41D 13/1161 128/858
D418,256 S 12/1999 Caruana
6,010,215 A 1/2000 Miceli
6,016,808 A 1/2000 Landis
6,024,446 A 2/2000 Hall et al.
6,055,982 A 5/2000 Brunson et al.
6,079,980 A 6/2000 Durand
6,247,811 B1 6/2001 Rhoades et al.
6,308,711 B1 10/2001 Goldberg
D458,713 S 6/2002 Cheng
6,564,804 B2 5/2003 Salatka et al.
6,611,966 B1 9/2003 Takahashi
6,666,554 B2 12/2003 Muley
6,718,561 B2 4/2004 Dondero
6,718,981 B2 4/2004 Cardarelli
6,783,235 B1 8/2004 Lin
6,783,236 B2 8/2004 Chou
6,935,741 B2 8/2005 Denney
6,948,812 B2 9/2005 Wichner
6,959,989 B2 11/2005 Holm
6,964,067 B1 11/2005 Hartman
6,996,846 B1 2/2006 Karapetyan
7,029,114 B2 4/2006 Smith
7,039,959 B2 5/2006 Dondero
7,058,991 B2 6/2006 Hartman et al.
D539,485 S 3/2007 Huh
7,188,625 B2 3/2007 Durette
7,272,860 B2 9/2007 Vega et al.
D559,442 S 1/2008 Regelbrugge et al.
D568,545 S 5/2008 Schaffner
7,490,359 B2 2/2009 Landis
7,712,894 B2 5/2010 Tsai
7,725,949 B2 6/2010 Landis
7,921,468 B2 4/2011 Sutton
8,214,921 B2 7/2012 Grad et al.
8,291,512 B2 10/2012 Stoll
8,458,813 B2 6/2013 Grad et al.
8,707,462 B2 4/2014 Grad et al.
D732,242 S * 6/2015 Miller ..... D29/110
2001/0009450 A1 7/2001 Da Vie
2002/0071088 A1 6/2002 Cardenas
2004/0141148 A1 7/2004 Chou
2005/0039240 A1 2/2005 Kidouchim
2005/0052610 A1 3/2005 Denney
2005/0052612 A1 3/2005 Kidouchim
2005/0174532 A1 8/2005 Wichner
2005/0268384 A1 12/2005 Hartman
2005/0268385 A1 12/2005 Hartman et al.
2006/0017880 A1 1/2006 Smith
2006/0050224 A1 3/2006 Smith
2006/0106401 A1 5/2006 Deutschmann et al.
2006/0176441 A1 8/2006 Katz et al.
2006/0243286 A1 11/2006 Durette
2006/0256278 A1 11/2006 Amioka
2007/0211208 A1 9/2007 Cunningham et al.
2007/0252944 A1 11/2007 Welchel et al.
2007/0279583 A1 12/2007 Bovee
2009/0073376 A1 3/2009 Swift
2009/0279047 A1 11/2009 Tsai
2009/0307817 A1 12/2009 Stachler et al.

(56) References Cited

U.S. PATENT DOCUMENTS

| | | | | |
|---|---|---|---|---|
| 2009/0316106 | A1 | 12/2009 | Kitayama | |
| 2010/0073625 | A1 | 3/2010 | Engstrom | |
| 2010/0253903 | A1 | 10/2010 | Weston | |
| 2012/0047614 | A1* | 3/2012 | Choi ..... | A41D 13/1184 2/9 |

* cited by examiner

DISPOSABLE FACE SHIELD

CROSS-REFERENCE TO RELATED APPLICATION

This application is a continuation in part and claims the benefit of priority of U.S. Design Patent Application Ser. No. 29/482,840 filed Feb. 21, 2014, the entire contents of which are hereby expressly incorporated by reference into the present application.

BACKGROUND OF THE INVENTION

1. Field of the Invention

The present invention relates in general to the field of face shields. More particularly, the present invention relates to a disposable face shield with a shield with a plurality of cuts, a foam member, and an adjustable elastic band.

2. Discussion of the Related Art

Face shields are used in a variety of industries to prevent splatter of liquids or materials against a user's face. For instance, these types of shields are commonly used in medical and dental applications during procedures or surgeries to prevent splatter of a patient's blood or other bodily fluids in the operator's face. During an operation, a face shield that is soiled, dirtied, or contaminated needs to be quickly disposed of and replaced with a clean face shield. Therefore, it is most convenient to have disposable face shields made of inexpensive materials that can quickly be replaced. Most face shields are made of a flexible material such that they can easily conform to a variety of different users' heads regardless of the size or shape. Because the plastic does not comfortably rest on a user's head, face shields typically have a cushion or barrier that is located between the shield and the user's forehead. Even more importantly, the cushion or barrier provides an offset such that the shield does not abut a user's nose. The offset also provides the necessary space for a user's eyeglasses.

Face shields can be mounted to a user's head by a number of different mechanisms, for instance, by frames similar to those used for glasses, or other hooks or loops. Alternatively, straps or strings can be used to secure the shield to the user's head. Many shields feature elastic straps as they allow for stretchability to conform to different shaped heads. Elastic straps may be attached directly to the shield by glue or other fasteners, which prevents adjustability. However, a face shield with an adjustable mounting mechanism is appealing as it makes it easier for a wide variety of individuals to comfortably wear the same style of face shield. As such, it is desirable to have a shield with an elastic strap that is easily adjusted so that the shield is securely attached to a variety of different users' heads.

Another prevalent issue with face shields is that they easily fog due to the user's breathing. Obviously, this is a problem when a user needs a clear view during a medical procedure. Some shields have provided vent holes or openings along the top of the shield, for instance, along the cushion or barrier between the shield and the user's forehead. Such configurations allow for greater air movement between the shield and the user's face. Still, there is risk that splatter could enter these holes. Therefore, it is desirable to have a face shield, with vent holes that prevent fogging of the shield while minimizing the risk of splash contamination into the holes from above.

SUMMARY AND OBJECTS OF THE INVENTION

By way of summary, the present invention is directed to a face shield. A primary object of the invention is to provide an apparatus that has a flexible and transparent shield that is configured to cover a user's face. The shield has a plurality of cuts, the cuts having portions of the shield material therebetween. For instance, the shield has a first pair of parallel slits adjacent to a first edge and a second pair of parallel slits adjacent to the second edge. Additionally, the plurality of cuts can be along a top edge of the shield. Alternatively, the shield may have both the first and second pair of parallel slits and a plurality of cuts in the top edge of the shield.

In accordance with another aspect of the invention, a foam member is attached to the shield that provides an offset between the shield and the user's face when the face shield is in use. The foam member is attached to the shield along the top edge of the shield. To increase air movement about the shield, the foam member can have a plurality of openings that extend through the foam. For instance, the openings can be along a front side of the foam member such that the holes abut the shield. Alternatively, the holes can be offset such that they are located between the front edge of the foam member and the back edge of the foam member. The openings can be any number of different shapes, for instance, semi-circular. In embodiments where the foam member has openings, the shield can have a plurality of cuts along the top edge of the shield. The cuts in the shield form a plurality of tabs that at least partially cover the openings in the foam. When the face shield is in use, the cuts allow the tabs to become articulated and overlap one another. As a result, the shield can bend about the user's face without deformation. The tabs reduce the risk of any splatter entering the holes of the foam member. Additionally, the foam member may have a plurality of recesses or wedge cuts that facilitate curvature of the foam member about the user's face. Because the foam member is attached to the shield, this will cause the shield to also curve around the user's face. The wedge cuts can be any number of different shapes, for instance, triangular. This would help encourage curvature of the foam member.

In accordance with another aspect of the invention, an elastic strap is used to mount the face shield to a user's head. For instance, in the embodiment with two pairs of parallel slits, an elastic strap is received between the first pair of parallel slits and the second pair of parallel slits. This allows the elastic to be secured to the shield, but also allows the elastic strap to be adjusted such that it is tight-fitting to a user's head.

Another primary object of the invention is to provide a method of assembling the face shield. First, a sheet of transparent plastic material is cut into the configuration of the shield. Next, a pair of parallel slits is cut into the shield along a first edge. Another pair of parallel slits is cut into the shield along a second edge. After the slits are cut, a foam member is attached to the shield between the first and second pair of slits. The foam member can have a plurality of openings to increase air movement about the shield. The openings may be formed along a front edge of the foam member that is attached to the shield. Alternatively, the openings may be formed between the front edge of the foam member and the back edge of the foam member such that they are offset from the front edge. An elastic strap is then threaded through the first and second pair of slits. The slits are configured such that the elastic strap is held in place, but can be adjusted such that it fits tightly around the user's head.

Additionally, tabs can be formed along a top edge of the shield above the foam member. The tabs can then be bent slightly such that the openings are at least partially covered.

In yet another object of the invention, a face shield is provided with a flexible transparent shield with a plurality of tabs located along a top edge. A foam member is attached to the shield below the tabs. An elastic strap is adjustably attached to the shield.

In accordance with another aspect of the invention, the shield can also have two pairs of parallel slits located on opposite sides of the shield. The two pairs of parallel slits may be located concentrically about the center of the shield. The elastic strap can slide between the first pair of parallel slits and the second pair of parallel slits. This allows the shield to be adjusted such that it is securely attached to a user's head.

In accordance with yet another aspect of the invention, the foam member may have a plurality of openings that extend through the foam member to improve air movement. The openings may be located along a front edge of the foam member. Alternatively, the openings may be located between the front edge of the foam member and the back edge of the foam member. Additionally, the foam member may have a number of wedge cuts along the back edge of the foam member. For instance, the wedge cuts can be triangular in shape. These wedge cuts allow the foam member to curve about the user's head.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views.

Figure 1:
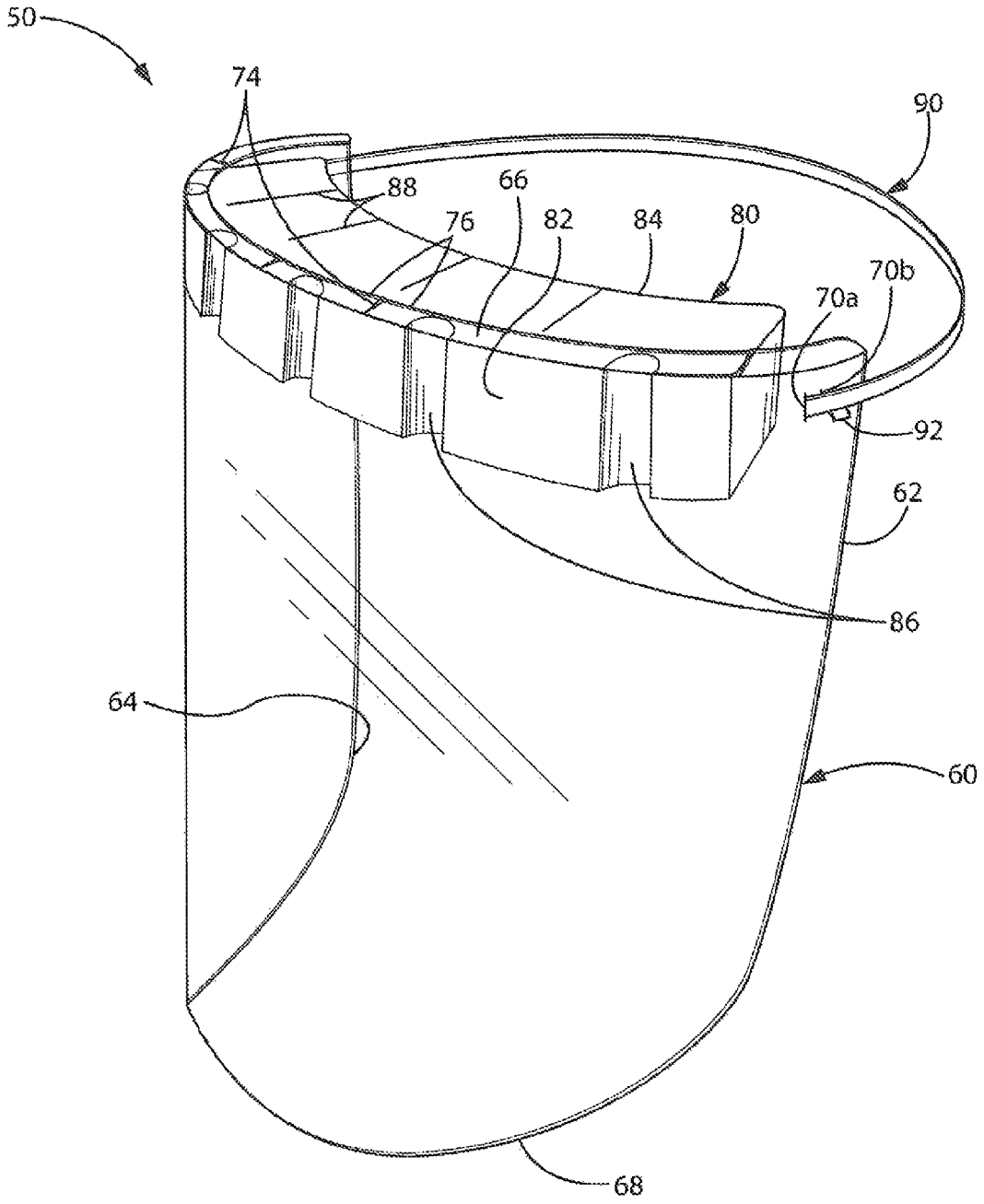
FIG. 1 is an isometric view of a disposable face shield with a foam pad with openings along the front edge of the foam pad, wherein the shield has tabs bent to a substantially horizontal position to cover the openings.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the words "connected", "attached", or terms similar thereto are often used. They are not limited to direct connection but include connection through other elements where such connection is recognized as being equivalent by those skilled in the art.

DESCRIPTION OF PREFERRED EMBODIMENTS

The present invention and the various features and advantageous details thereof are explained more fully with reference to the non-limiting embodiments described in detail in the following description.

1. System Overview

The face shield includes a shield, a foam member with openings, and an elastic strap. The openings in the foam member may be along a front edge of the foam member. This configuration should be used when adhesive is only applied to the portions of the front edge of the foam member that actually touch the shield. Use of excess adhesive where the openings are located is unsightly and could result in a user's hair getting stuck to the adhesive. Alternatively, the openings in the foam member may be recessed back from the front edge of the foam member such that the front edge is continuous. This configuration should be used when the adhesive or tape is continuous along the shield, as there will not be an exposed adhesive. Along the top edge of the face shield is a slanted roof section which is important as this section provides partial coverage of the openings, minimizing splash down. These tabs bend over the full length of the foam member. The tabs will slightly overlap as the face shield bends around a user's face.

Additionally, the shield has two cuts along opposite sides of the shield. These cuts are configured such that an elastic strap can be threaded through the cuts and held in place by the location of the cuts. This allows the elastic strap to be adjusted to a user's head.

2. Detailed Description of Preferred Embodiments

Referring initially to FIG. 1, a disposable face shield 50 is provided having a shield 60, a foam member 80, and an elastic strap 90. FIG. 1 provides, the face shield 50 in a flexed position where the shield 60 and the foam member 80 are curved. The shield 60 is made of a thin, flexible, transparent material such as plastic. This allows the user to easily see through the shield 60. Alternatively, the shield 60 could be made out of tinted material. This would allow a user to still see through the shield 60, but would prevent glare a user may experience in certain working conditions. The shield 60 could be made of an inexpensive material, as it is disposable. For instance, the shield 60 may be made of polyester or optically clear polyester.

Continuing to look at FIG. 1, the shield 60 has a top edge 66, a first side edge 62, a second side edge 64, and a generally rounded bottom 68 that extend downward from the first side edge 62 and the second side edge 64. Although the illustrated bottom 68 is in a generally circular shape, the bottom could extend downward in any number of configurations as known in the art. The shield 60 is dimensioned to cover substantially all of a user's face without getting in the user's way as they use their hands for surgeries, operations, and the like. The configuration of the shield 60 is especially useful for operations where the user would be exposed to spraying liquids, such as blood or other bodily fluids during medical operations. The shield 60 could also be used in other applications where there is risk of objects flying into the user's face, such as painting and woodworking. The shield 60 need not extend to cover a user's entire face, but rather will only cover a portion of the user's face, for instance, the user's eyes.

Still looking at FIG. 1, the face shield 50 also has a foam member 80 attached to the shield 60 along the top edge 66 of the shield 60. The foam member 80 can be made of any number of materials that would provide cushion to the user's head, preferably, a material that can be affordably manufactured. For instance, the foam member 80 could be made of polyurethane foam. The foam member 80 may be glued to the shield 60. Alternatively, the foam member 80 could be taped or mechanically attached using fasteners. The foam member 80 is primarily configured to create separation between the shield 60 and the user's head. This allows the shield 60 to extend downward in a substantially vertical position without uncomfortably hitting the user's nose. Also, the foam member 80 increases the comfort of use.

A plurality of openings 86 is located in the foam member 80. The openings 86 increase the amount of air movement around the shield 60 and between the user's face and the shield 60. This is especially helpful as a user's breath can cause the shield 60 to easily fog. Without the openings 86, air would be trapped between the shield 60 and the user's face. As shown in FIG. 1, the openings 86 may be located along the front edge 82 of the foam member 80. This allows air to move up along the shield 60 and out through the openings 86. The team member 80 may have a plurality of recesses or wedge cuts 88 along the back edge 84 of the member 80. As seen in FIG. 1, the wedge cuts 88 allow the foam member 80 to bend around the user's head. Because the foam member 80 is attached to the shield 60, the shield 60, too, will bend around and conform to the user's head. This helps to ensure that the shield 60 will cover substantially all of the user's face.

The shield 60 may include a series of cuts 74 along the top edge 66 of the shield 60. The cuts 74 form a plurality of tabs 76 along the length of the top edge 66. These tabs 76 may be bent over such that they are substantially horizontal, as can be seen in FIG. 1. The tabs 76 could also be left in a substantially vertical position. Regardless of the configuration, the tabs 76 are configured to substantially cover the openings 86. This helps minimize the amount of blood and other fluids that may enter the openings 86 and fall down into the user's face. In turn, this helps to avoid the spread of infectious diseases. The cuts 74 allow the tabs 76 to become articulated and to slightly overlap when the face shield 50 is engaged. As a result, the tabs 76 curve with the shield 60. Without the cuts 74, the portion of the shield 60 above the foam member 80 would either stand straight up or deform when the the shield 50 is engaged by a user.

Continuing to look at FIG. 1, the shield 60 also has a pair of parallel slits 70*a*, 70*b* adjacent to the first side edge 62 of the shield 60. A portion 100 of the plastic material of the shield 60 remains between the pair of parallel slits 70*a*, 70*b*. The slits 70*a*, 70*b* are configured such that an elastic strap can be threaded through the slits 70*a*, 70*b*. Because of the close proximity between the parallel slits 70*a*, 70*b* and the portion of plastic material 100 between the slits, the elastic strap 90 is held in place when the face shield 50 is in use. The elastic strap 90 can be adjusted by sliding the first end 92 of the strap 90 through the pair of slits 70*a*, 70*b*. As can be seen, the first end 92 of the strap 90 can be threaded first through the first parallel slit 70*a* and then through the second slit 70*b*. As a result, the end of the strap 92 extends in a direction opposite to that of the strap 90 before it enters the parallel slits 70*a*, 70*b*. This configuration helps to keep the strap 90 securely connected to the shield 60. If the strap 90 is pot in tension, it will bind itself and resist movement out of the slits 70*a*, 70*b*.

Figure 2:
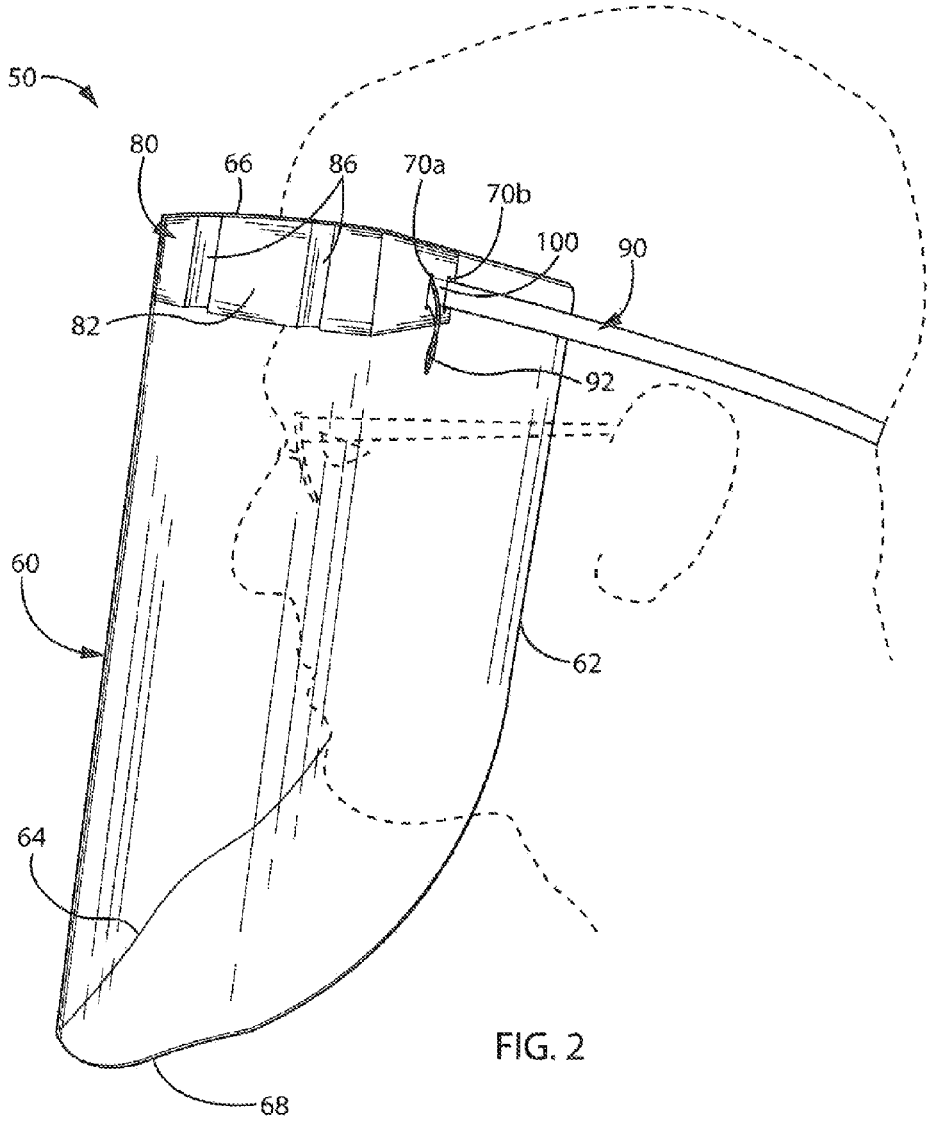
FIG. 2 is a side isometric view of the disposable face shield of FIG. 1.

Moving next to FIG. 2, the face shield 50 is shown in use from a side angle. For greater understanding, an outline of a user is provided. Again, the face shield 50 has a shield 60, a foam member 80, and an elastic strap 90. The shield 60 has a top edge 66, a first side edge 62, a second side edge 64, and a generally rounded bottom 68 that extends downward from the first side edge 62 and the second side edge 64. The shield 60 is dimensioned to cover substantially all of a user's face without getting in the user's way as they use their hands for surgeries, operations, and the like.

Still looking at FIG. 2, the face shield 50 also has a foam member 80 attached to the shield 60 along the top edge 66 of the shield 60. A plurality of openings 86 is located in the foam member 80 to increase the amount of air movement around the shield 60 and between the user's face and the shield 60. These openings 86 are located along the front edge 82 of the foam member 80 which allows air to move up along the shield 60 and out through the openings 86. The foam member 80 bends about the user's head and, because the foam member 80 is attached to the shield 60, it, too, will bend about the user's head.

Continuing to look at FIG. 2, the shield 60 also has a pair of parallel slits 70*a*, 70*b* adjacent to the first side edge 62 of the shield 60. A portion 100 of the plastic material of the shield 60 remains between the pair of parallel slits 70*a*, 70*b*. The slits 70*a*, 70*b* are configured such that an elastic strap can be threaded through the slits 70*a*, 70*b*. Because of the close proximity between the parallel slits 70*a*, 70*b* and the portion of plastic material 100 between the slits, the elastic strap 90 is held in place when the face shield 50 is in use. The elastic strap 90 can be adjusted by sliding the first end 92 of the strap 90 through the pair of slits 70*a*, 70*b*. In this configuration, the end 92 of the strap 90 is fed first through the second slit 70*b* and then through the first, slit 70*a*. As a result, the strap 90 can easily be adjusted or removed from the slits 70*a*, 70*b*. The preferred configuration, however, is where the end 92 of the strap 90 is fed first through the first slit 70*a* and then through the second slit 70*b*, which results in the end 92 extending in a direction opposite the portion of the strap 90 just before it enters the slits 72*a*, 72*b*. This configuration helps to secure the strap 90 and prevents movement of the strap 90.

Figure 3:
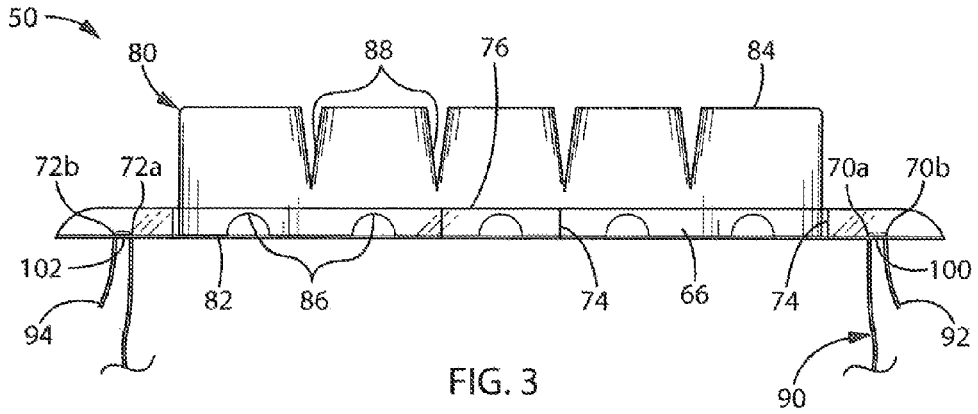
FIG. 3 is a top plan view of the disposable face shield of FIG. 1.

Moving now to FIG. 3, the face shield 50 is shown lying flat, which occurs when the elastic strap 90 is not engaged. This particular view of the face shield 50, shown from a top view, better illustrates the features of the foam member 80 attached to the shield 60. A plurality of openings 86 is located in the foam member 80 that increases the amount of air movement around the shield 60 and between the user's face and the shield 60. As shown, the openings 86 may be located along the front edge 82 of the foam member 80. This allows air to move up along the shield 60 and out through the Openings 86. Additionally, the foam member 80 may have a plurality of wedge cuts 88 along the back edge 84 of the member 80. For instance, the wedge cuts 88 may be triangular in shape. This shape of wedge cuts 88 allows the foam member 80 to bend around the user's head. Because the foam member 80 is attached to the shield 60, the shield 60, too, will bend around and conform to the user's head. This helps to ensure that the shield 60 will cover substantially all of the user's face.

Still looking to FIG. 3, the shield 60 may include a series of cuts 74 along the top edge 66 of the shield 60. The cuts 74 form a plurality of tabs 76 along the length of the top edge 66. As can be seen, these tabs 76 cover the openings 86 which helps prevent blood and other fluids from entering the openings 86 and falling, down into the user's face. In turn, this helps to avoid the spread of infectious diseases. As can be seen, the tabs 76 line up but do not overlap one another when the shield 60 lies flat.

Figure 4:
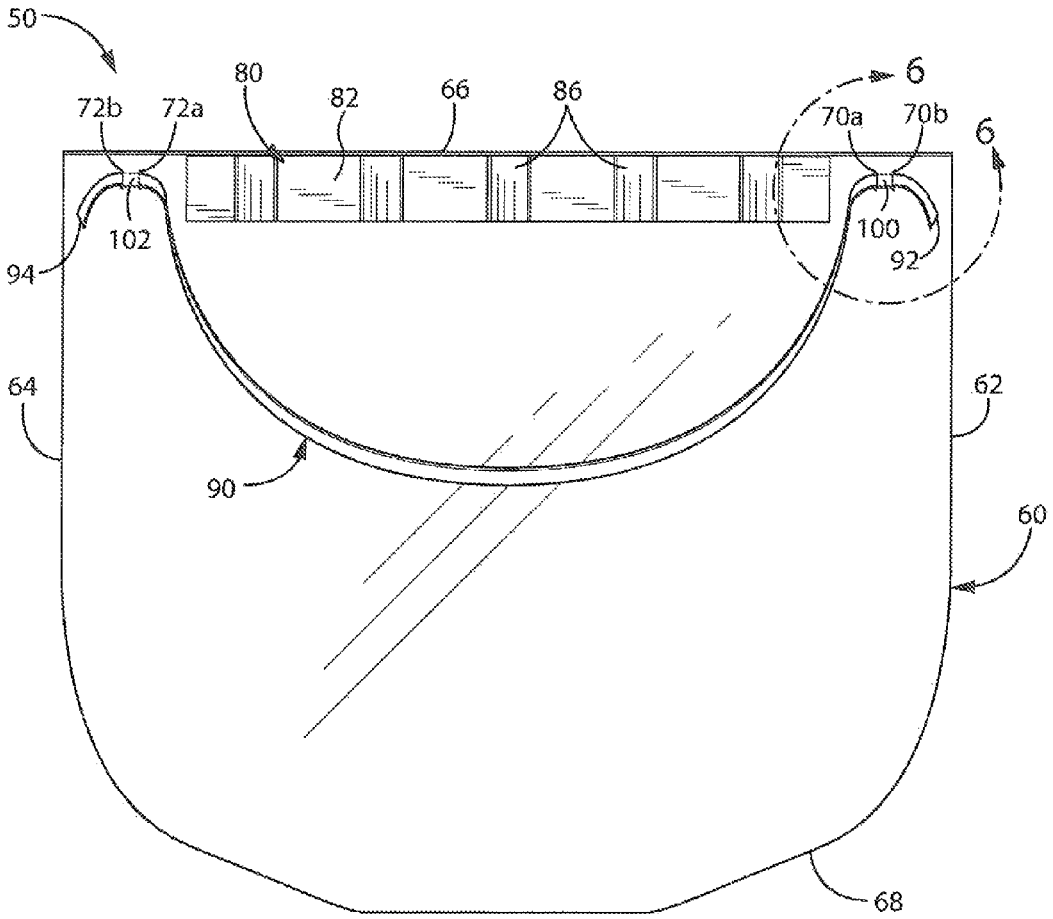
FIG. 4 is a front elevation view of the disposable face shield of FIG. 1.

Turning to FIG. 4, a front elevation view of the shield 50 is provided, wherein the shield 50 is again lying flat because the elastic strap 90 is not engaged. The shield 60 has a top edge 66, a first side edge 62, a second side edge 64, and a generally rounded bottom 68 that extends downward from the first side edge 62 and the second side edge 64.

The front edge 82 of the foam member 80 is shown to better illustrate the configuration of the plurality of openings 86. The openings 86 increase the amount of air movement around the shield 60 and between the user's face and the shield 60.

Figure 6:
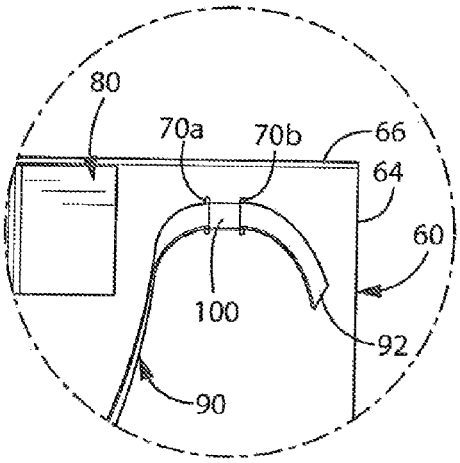
FIG. 6 is an enlarged view of reference line 6 of FIG. 4.

Still looking at FIG. 4, the shield 60 has a pair of parallel slits 70*a*, 70*b* adjacent to the first side edge 62 of the shield 60. A portion 100 of the plastic material of the shield 60 remains between the pair of parallel slits 70*a*, 70*b*. In fact, FIG. 6 provides a detailed view of this pair of parallel slits 70*a*, 70*b* and the interaction of the elastic strap 90. Turning back to FIG. 4, the shield 60 has a second pair of parallel slits 72*a*, 72*b* adjacent to the second side edge 64, also with a portion 102 of the plastic material of the shield 60 between. The slits 70*a*, 70*b*, 72*a*, 72*b* are configured such that an elastic strap 90 can be threaded through the slits 70*a*, 70*b*, 72*a*, 72*b*. More specifically, the first end 92 of the elastic strap 90 is threaded first through slit 70*a* and then through 70*b*. The second end 94 of the elastic strap 90 is threaded first through slit 72*a* and then through 7*n*. Because of this configuration, the close proximity between the parallel slits 70*a*, 70*b* and 72*a*, 72*b*, and the portions of plastic material 100, 102 between the slits, the elastic strap 90 is held in place when the face shield 50 is in use. The elastic strap 90 can be adjusted by sliding either the first end 92 or the second end 94 of the strap 90 through either pair of slits 70*a*, 70*b* and 72*a*, 72*b*. Alternatively the elastic strap 90 can also be attached to the shield 60 in other ways, for instance, by glue, fasteners or other mechanical connections. Although two pairs of parallel slits is preferred, the elastic strap could alternatively be mechanically fastened or glued on one side of the shield 60, and adjustably engaged by one pair of parallel slits, either 70*a*, 70*b* or 72*a*, 72*b*.

Figure 5:
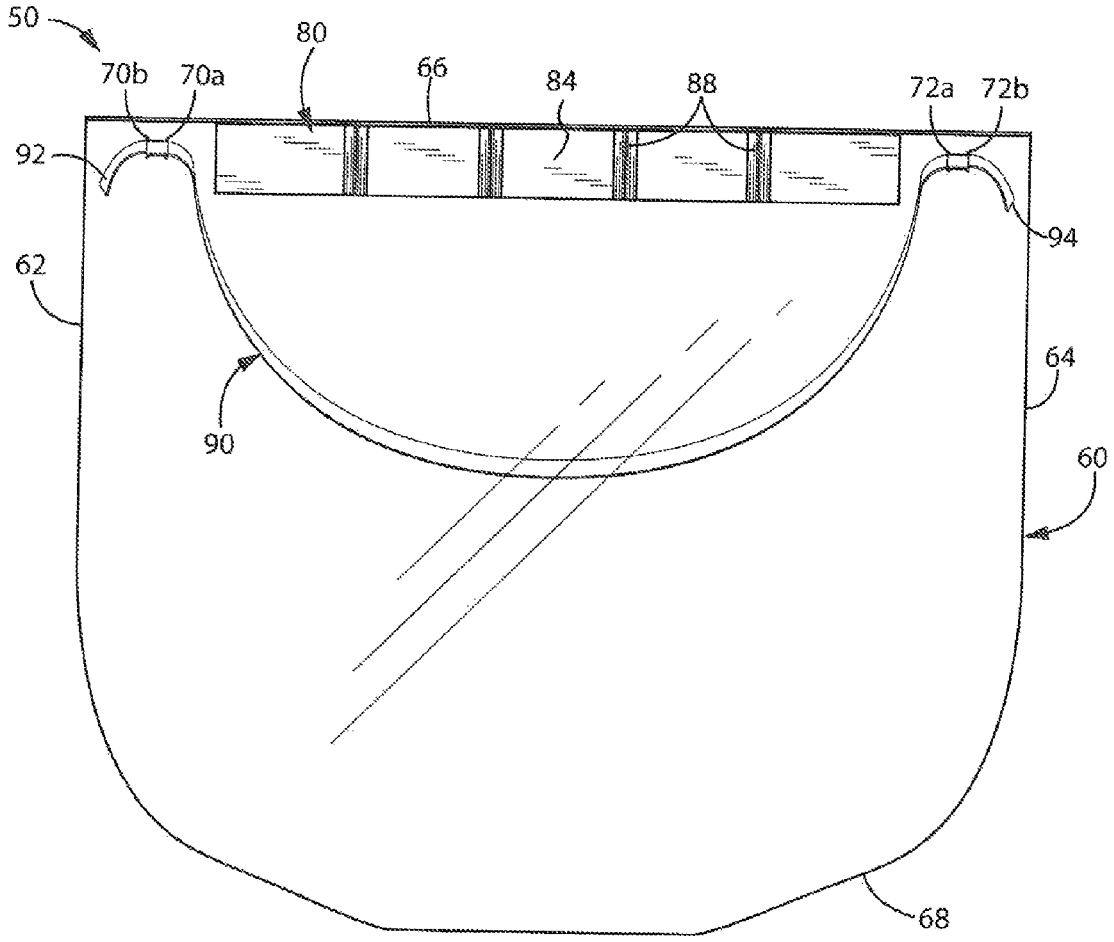
FIG. 5 is a rear elevation view of the disposable face shield of FIG. 1.

Looking next at FIG. 5, a reverse elevation view of the face shield 50 is provided where the shield 60 lies flat. Again, the two pairs of parallel slits 70*a*, 70*b*, 72*a*, 72*b* are illustrated. Additionally, the plurality of wedge cuts 88 along the back edge 84 of the foam member is shown. These wedge cuts 88 are triangular in shape, which allows the foam member 80 to easily bend about the user's head.

Figure 7:
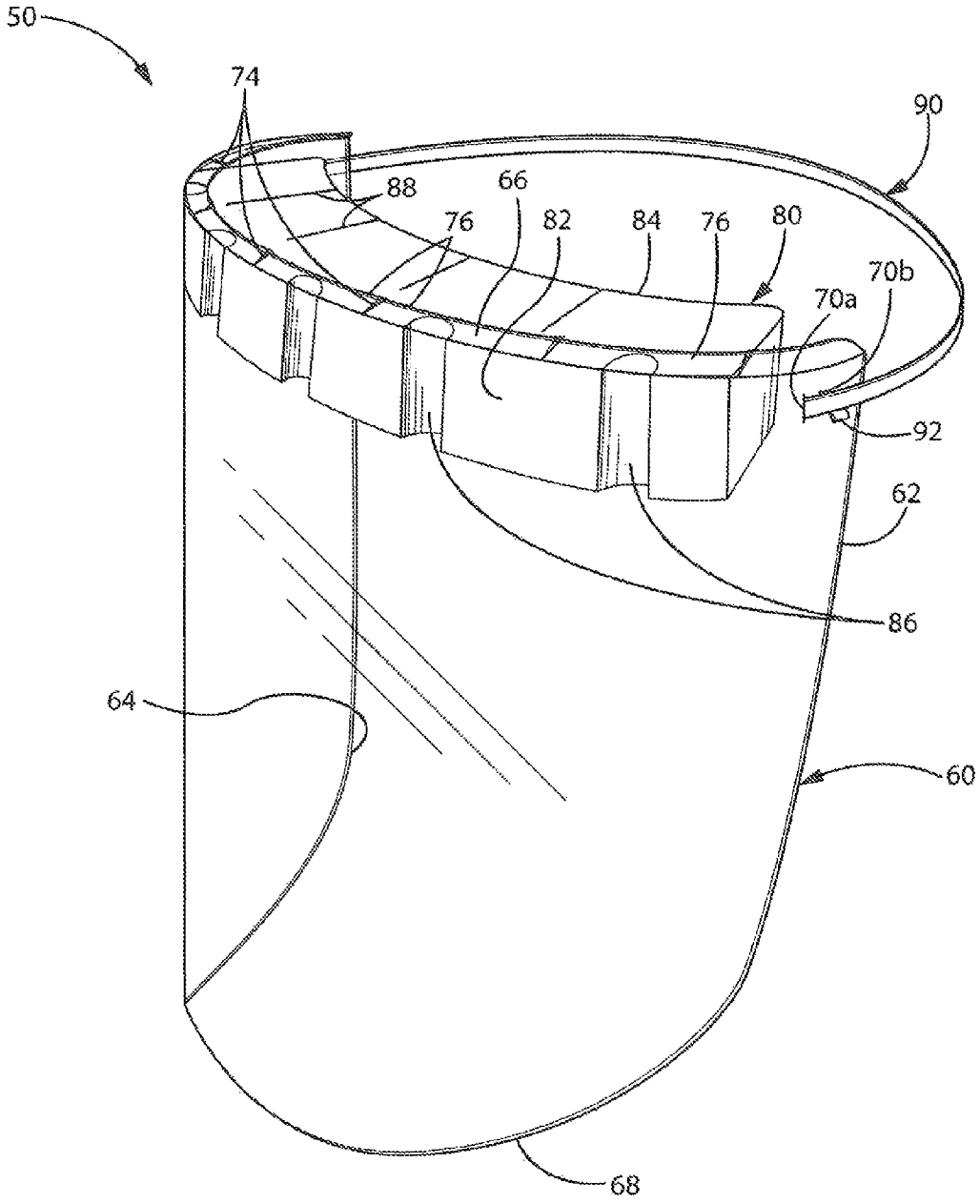
FIG. 7 is an isometric view of a disposable face shield with a foam pad with openings along the front edge of the foam pad, wherein the shield has tabs bent to approximately 45 degrees to cover the openings.

FIG. 7 provides the face shield 50 in a flexed position where the shield 60 and the foam member 80 are curved. The shield 60 has a top edge 66, a first side edge 62, a second side edge 64, and a generally rounded bottom 68 that extend downward from the first side edge 62 and the second side edge 64. Along the top edge 66, the shield 60 has a plurality of cuts 74. The cuts 74 form a plurality of tabs 76 along the length of the top edge 66. These tabs 76 may be bent over to a 45-degree angle to substantially cover the openings 86 in the foam member 80. This helps prevent materials from entering the openings 86 and filling down into the user's face. The cuts 74 allow the tabs 76 to become articulated and to slightly overlap when the face shield 50 is engaged. As a result, the tabs 76 curve with the shield 60. Without the cuts 74, the portion of the shield 60 above the foam member 80 would either stand straight up or deform when the face shield 50 is engaged by a user.

Again, the face shield 50 in FIG. 7 also has a foam member 80 attached to the shield 60 along the top edge 66 of the shield 60. The plurality of openings 86 is located in the foam member 80 along the front edge 82 of the foam member 80 and provides for air circulation around the face shield 50. This prevents fogging of the shield 60.

Figure 8:
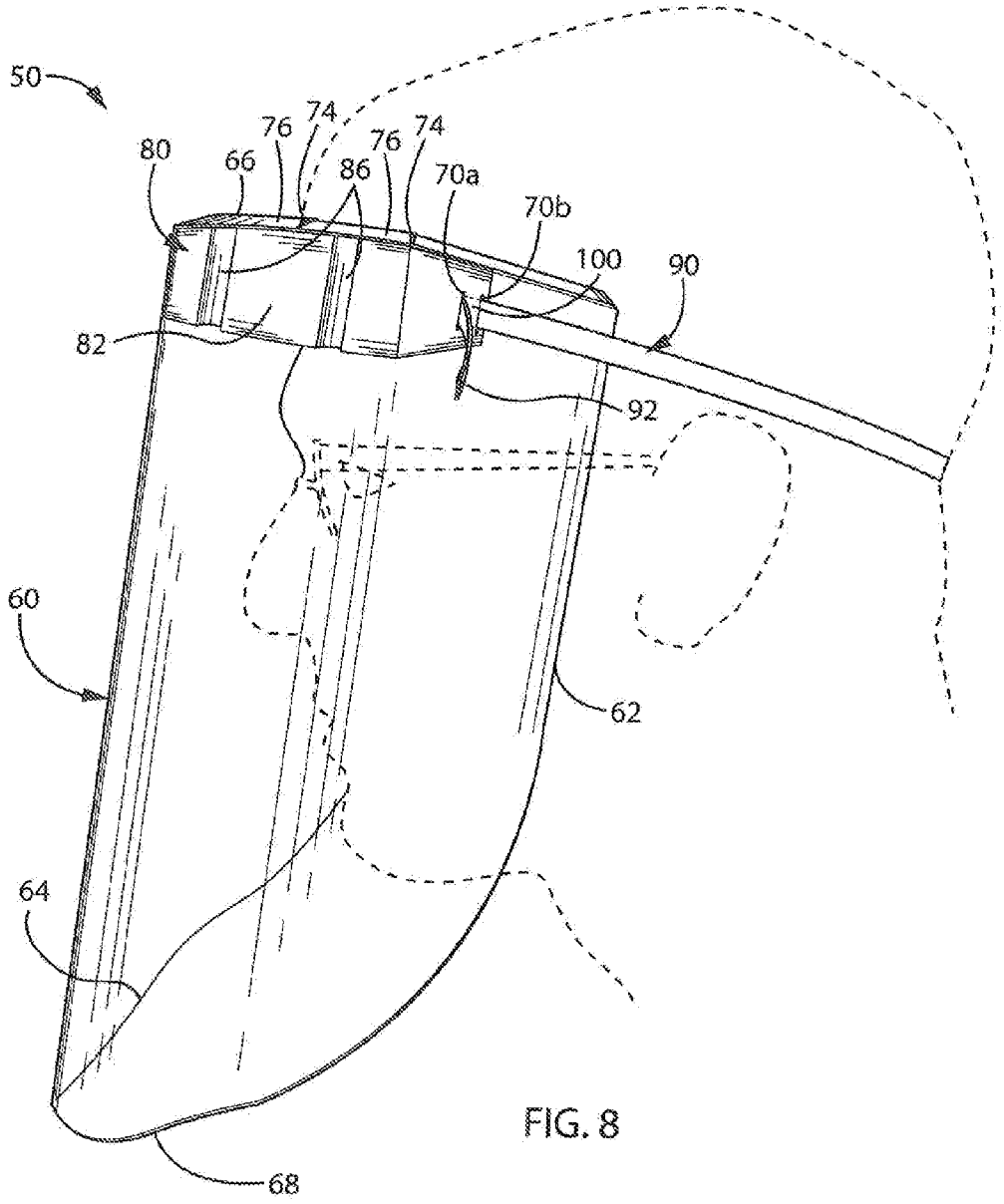
FIG. 8 is a side isometric view of the disposable face shield of FIG. 7.

Moving next to FIG. 8, the face shield 50 is shown in use from a side angle. For greater understanding, an outline of a user is provided. Again, the shield 60 has a top edge 66, a first side edge 62, a second side edge 64, and a generally rounded bottom 68 that extend downward from the first side edge 62 and the second side edge 64. The shield 60 is dimensioned to cover substantially all of a user's face without getting in the user's way as they use their hands for surgeries, operations, and the like.

Still looking at FIG. 8, the face shield 50 also has a foam member 80 with a plurality of openings 86 along the front edge 82 attached to the shield 60. The openings 86 increase the amount of air movement around the shield 60 and between the user's face and the shield 60. Additionally, the face shield 50 has a pair of parallel slits 70*a*, 70*b* adjacent to the first side edge 62 of the shield 60. A portion 100 of the plastic material of the shield 60 remains between the pair of parallel slits 70*a*, 70*b*. The slits 70*a*, 70*b* are configured such that an elastic strap can be threaded through the slits 70*a*, 70*b*. Because of the close proximity between the parallel slits 70*a*, 70*b* and the portion of plastic material 100 between the slits, the elastic strap 90 is held in place when the face shield 50 is in use. As shown, the first end 92 of the strap 90 is threaded first through the second slit 70*b* and then through the first slit 70*a*. As a result, the strap 90 can easily be adjusted or removed from the slits 70*a*, 70*b*. The preferred configuration, however, is where the end 92 of the strap 90 is fed first through the first slit 70*a* and then through the second slit 70*b*, which results in the end 92 extending in a direction opposite the portion of the strap 90 just before it enters the slits 72*a*, 72*b*. This configuration helps to secure the strap 90 and prevents movement of the strap 90.

Figure 9:
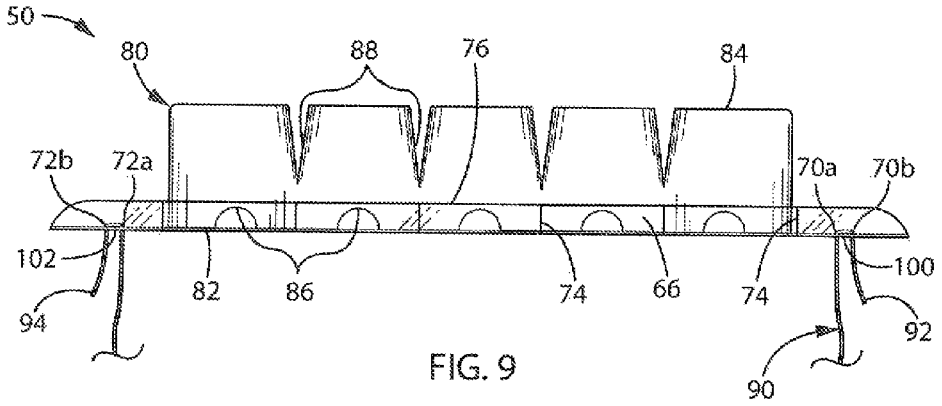
FIG. 9 is a top plan view of the disposable face shield of FIG. 7.

Moving now to FIG. 9, the face shield 50 is shown lying flat, which occurs when the elastic strap 90 is not engaged. This particular view of the face shield 50, shown from a top view, better illustrates the features of the foam member 80 attached to the shield 60. The plurality of openings 86 located in the foam member 80 increases the amount of air movement around the shield 60 and between the user's face and the shield 60. As shown, the openings 86 may be located along the front edge 82 of the foam member 80. Additionally, the foam member 80 may have a plurality of wedge cuts 88 along the back edge 84 of the member 80. For instance, the wedge cuts 88 may be triangular in shape. This shape of wedge cuts 88 allows the foam member 80 to bend around the user's head. Because the foam member 80 is attached to the shield 60, the shield 60 too will bend around and conform to the user's head.

Still looking to FIG. 9, the shield 60 may include a series of cuts 74 along the top edge 66 of the shield 60. The cuts 74 form a plurality of tabs 76 along, the length of the top edge 66. As can be seen, these tabs 76 cover the openings 86 which helps prevent blood and other fluids from entering the openings 86 and falling down into the user's face. As can be seen, the tabs 76 line up but do not overlap one another when the shield 60 lies flat.

Figure 10:
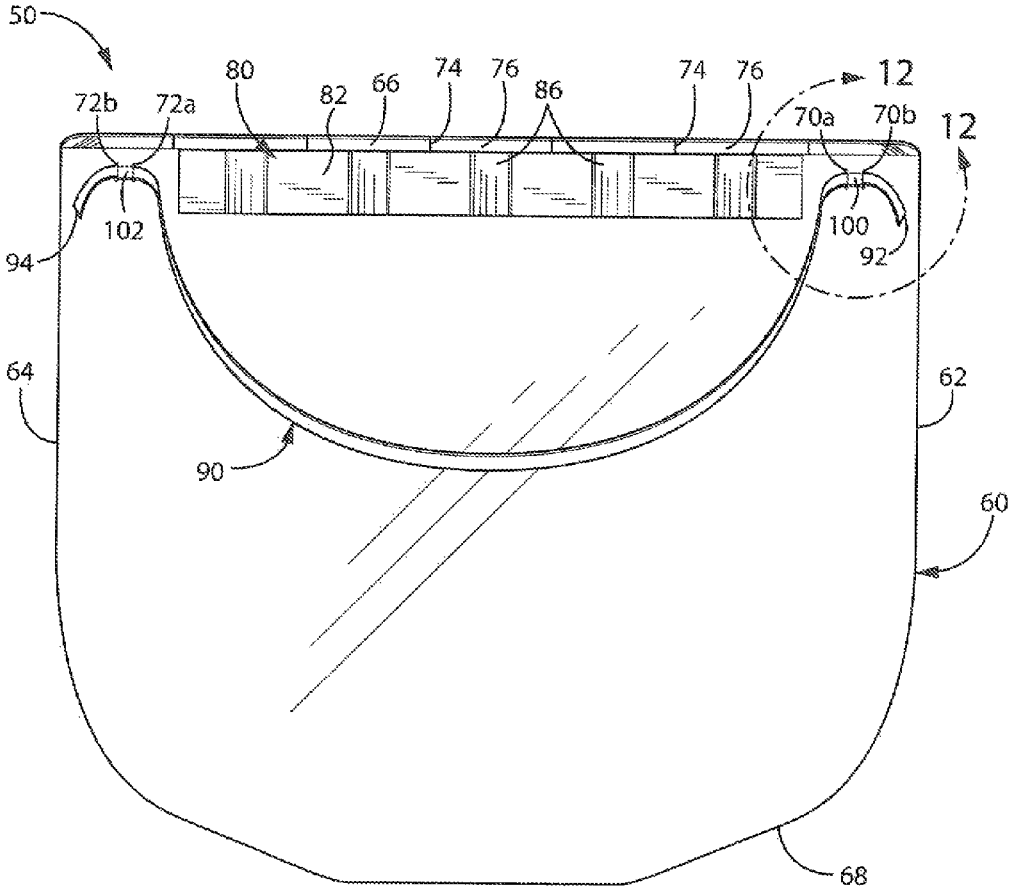
FIG. 10 is a front elevation view of the disposable face shield of FIG. 7.

Turning to FIG. 10, a front elevation view of the shield 50 is provided, wherein the shield 50 is again lying flat because the elastic strap 90 is not engaged. As can be seen, each of the tabs 76 is bent to a 45-degree angle. These tabs substantially cover the plurality of openings 86 of the foam member 80. This in turn reduces the risk that harmful materials may enter through the plurality of openings 86.

Figure 12:
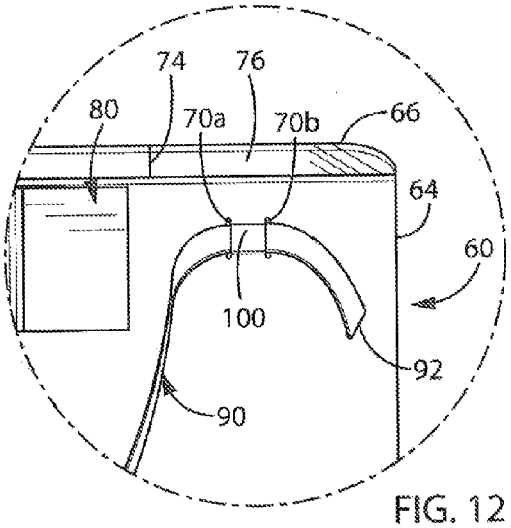
FIG. 12 is an enlarged view of reference line 12 of FIG. 10.

Still looking at FIG. 10, the shield 60 has a pair of parallel slits 70*a*, 70*b* adjacent to the first side edge 62 of the shield 60. A portion 100 of the plastic material of the shield 60 remains between the pair of parallel slits 70*a*, 70*b*. In fact, FIG. 12 provides a detailed view of this pair of parallel slits 70*a*, 70*b* and the interaction of the elastic strap 90. Turning back to FIG. 10, the shield 60 has a second pair of parallel slits 72*a*, 72*b* adjacent to the second side edge 64, also with a portion 102 of the plastic material of the shield 60 between. The slits 70*a*, 70*b*, 72*a*, 72*b* are configured such that an elastic strap can be threaded through the slits 70*a*, 70*b*, 72*a*, 72*b*. More specifically, the first end 92 of the elastic strap 90 is threaded first through slit 70*a* and then through 70*b*. The second end 94 of the elastic strap 90 is threaded first through slit 72*a* and then through 72*b*. Because of this configuration, the close proximity between the parallel slits 70*a*, 70*b* and 72*a*, 72*b*, and the portions of plastic material 100, 102 between the slits, the elastic strap 90 is held in place when the face shield 50 is in use. The elastic strap 90 can be adjusted by sliding either the first end 92 or the second end 94 of the strap 90 through either pair of slits 70*a*, 70*b* and 72*a*, 72*b*.

Figure 11:
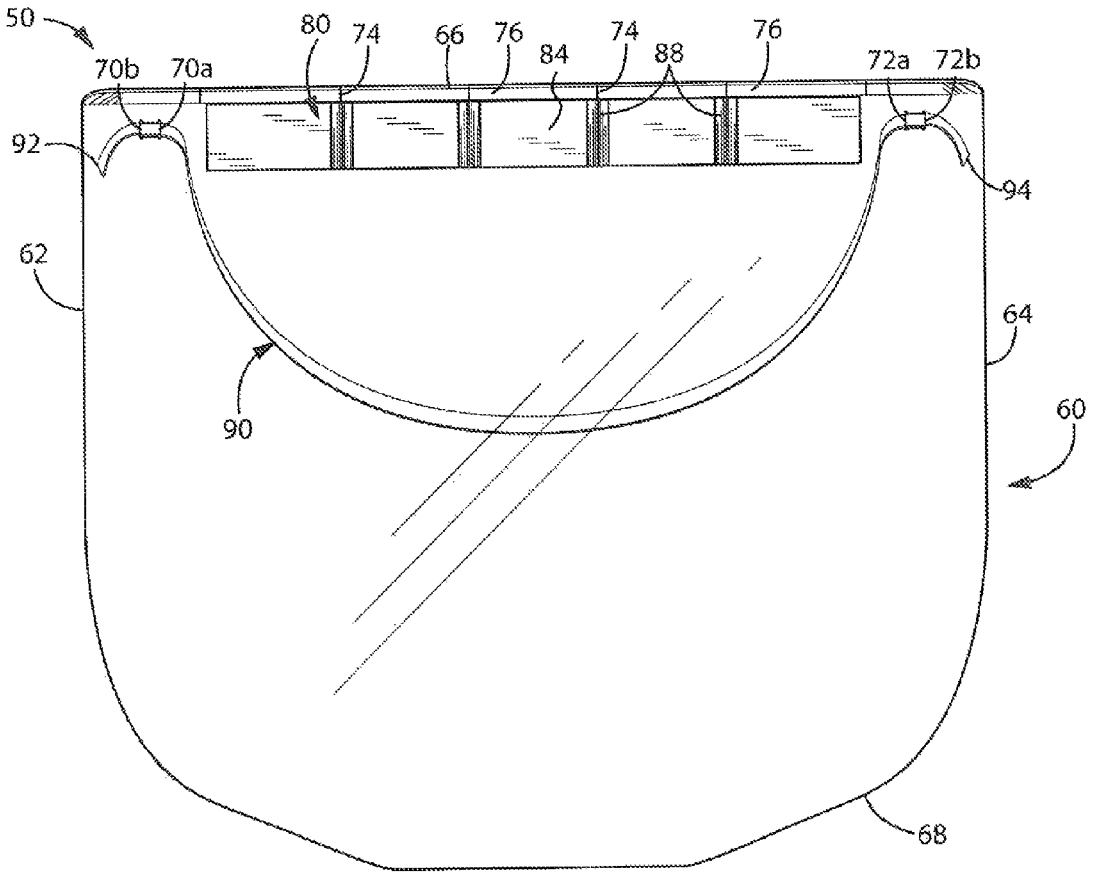
FIG. 11 is a rear elevation view of the disposable face shield of FIG. 7.

Looking next at FIG. 11, a reverse elevation view of the face shield 50 is provided where the shield 60 lies flat. Again, the two pairs of parallel slits 70*a*, 70*b*, 72*a*, 72*b* are illustrated. Additionally, the plurality of wedge cuts 88 along the back edge 84 of the foam member is shown. These wedge cuts 88 are triangular in shape, which allow the foam member 80 to easily bend about the user's head.

Figure 13:
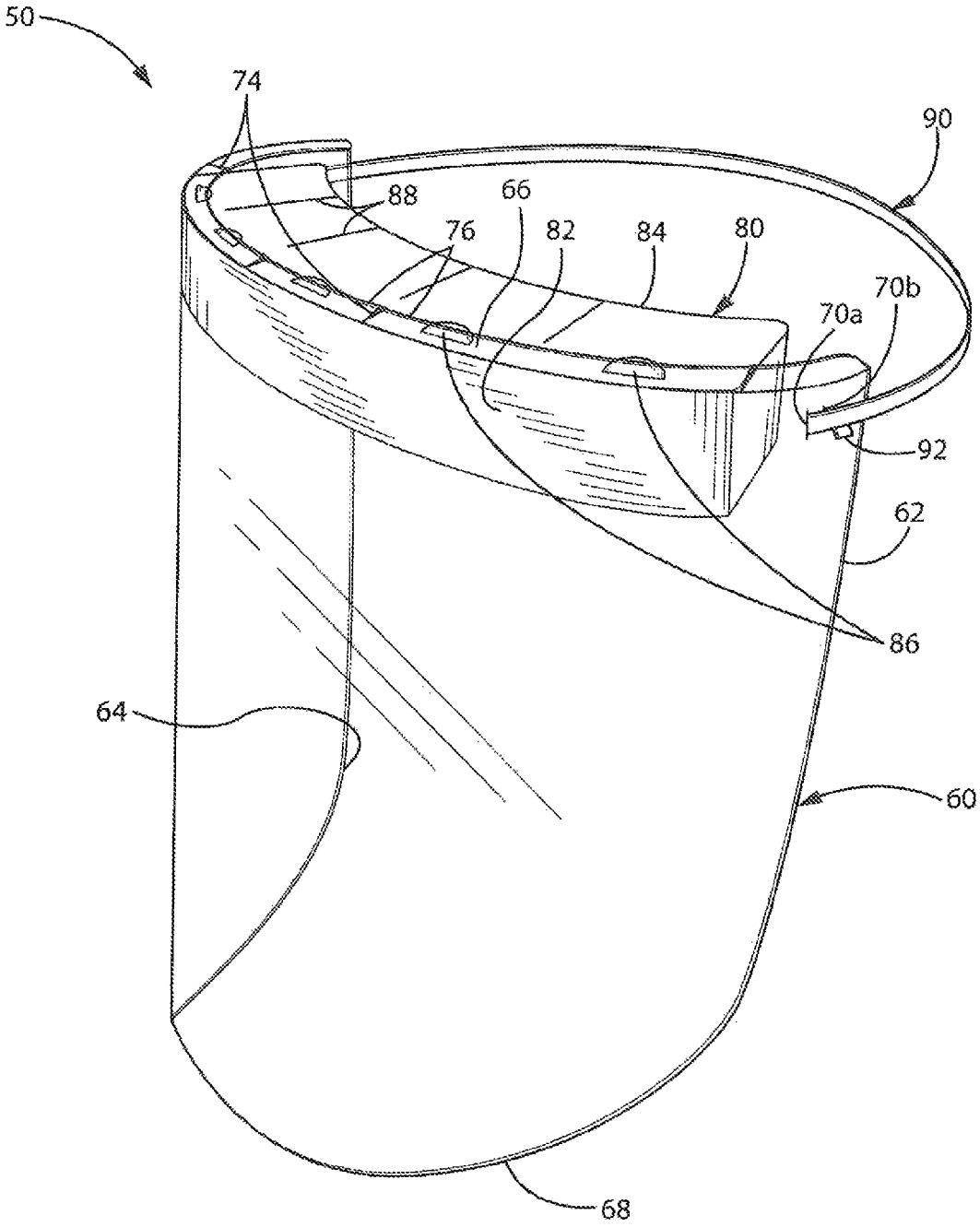
FIG. 13 is an isometric view of a disposable face shield with a foam pad with openings between the front edge and back edge of the foam pad, wherein the shield has tabs bent to a substantially horizontal position to cover the openings.

Moving now to FIG. 13, the face shield 50 is in a flexed position where the shield 60 and the foam member 80 are curved. The shield 60 has a top edge 66, a first side edge 62, a second side edge 64, and a generally rounded bottom 68 that extend downward from the first side edge 62 and the second side edge 64. Additionally, the face shield 50 has a foam member 80 attached to the shield 60. The foam member 80 has a plurality of openings 86 located between the front edge 82 and back edge 84 of the foam member 80. This configuration allows the front edge 82 of the foam member 80 to be continuous and, thus, easy to mount to the shield 60. The openings 86 increase the amount of air movement around the shield 60 and between the user's face and the shield 60.

Still looking to FIG. 13, the shield 60 includes a series of cuts 74 along the top edge 66, which form a plurality of tabs 76. These tabs 76 may be bent over such that they are substantially horizontal, as can be seen in FIG. 13. Regardless of the configuration, the tabs 76 are configured to substantially cover the openings 86. This helps prevent harmful substances from entering the openings 86 and falling down into the user's face. The cuts 74 allow the tabs 76 to become articulated and to slightly overlap when the face shield 50 is engaged. As a result, the tabs 76 curve with the shield 60. Without the cuts 74, the portion of the shield 60 above the foam member 80 would either stand straight up or deform when the face shield 50 is engaged by a user.

Figure 14:
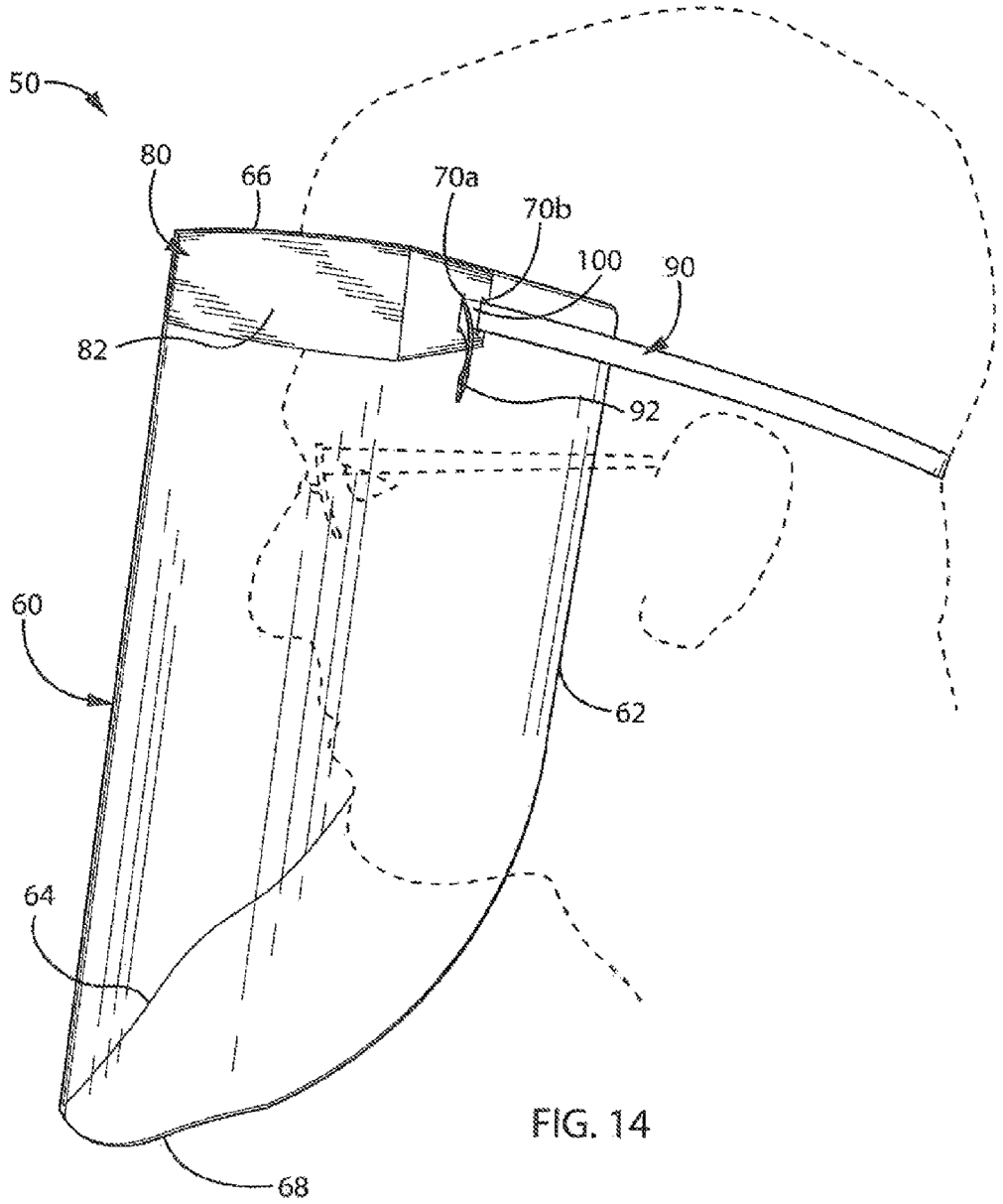
FIG. 14 is a side isometric view of the disposable face shield of FIG. 13.

Continuing to look at FIG. 13, the shield 60 also has a pair of parallel slits 70*a*, 70*b* adjacent to the first edge 62 of the shield 60. A portion 100 of the plastic material of the shield 60 remains between the pair of parallel slits 70*a*, 70*b*. The slits 70*a*, 70*b* are configured such that an elastic strap can be threaded through the slits 70*a*. 70*b*. Because of the close proximity between the parallel slits 70*a*, 70*b* and the portion of plastic material 100 between the slits, the elastic strap 90 is held in place when the face shield 50 is in use. The elastic strap 90 can be adjusted by sliding the first end 92 of the strap 90 through the pair of slits 70*a*, 70*b*. As can be seen, the first end 92 of the strap 90 can be threaded first through the first parallel slit 70*a* and then through the second slit 70*b*. As a result, the end of the strap 92 extends in a direction opposite to that of the strap 90 before it enters the parallel slits 70*a*, 70*b*. This configuration helps to keep the strap 90 securely connected to the shield 60. If the strap 90 is put in tension, it will bind itself and resist movement out of the slits 70*a*, 70*b*. Moving next to FIG. 14, the face shield 50 is shown in use from a side angle. For greater understanding, an outline of a user is provided. Again, the face shield 50 has a shield 60, a foam member 80, and an elastic strap 90. The foam member 80 is attached to the shield 60 along the top edge 66 of the shield 60. Because the plurality of openings 86 is not located along the front edge 82 of the foam member 80, but rather between the front edge 82 and back edge 84, the foam member 80 is continuous along the front edge 82. This makes it easier to mount the foam member 80 to the shield 60.

Figure 15:
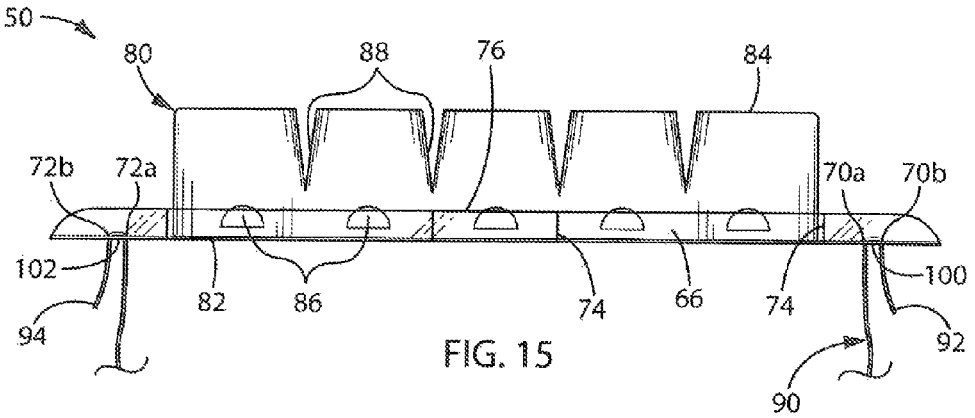
FIG. 15 is a top plan view of the disposable face shield of FIG. 13.

Moving now to FIG. 15, the face shield 50 is shown lying flat, which occurs when the elastic strap 90 is not engaged. This particular view of the face shield 50, shown from a top view, better illustrates the features of the foam member 80 attached to the shield 60. The plurality of openings 86 is located in the foam member 80 that increases the amount of air movement around the shield 60 and between the user's face and the shield 60. As shown, these openings 86 may be located between the front edge 82 and back edge 84 of the foam member 80. This allows air to move up along the shield 60 and out through the openings 86. Additionally, the foam member 80 may have a plurality of wedge cuts $8 along the back edge 84 of the member 80. For instance, the wedge cuts 88 may be triangular in shape. This shape of wedge cuts 88 allows the foam member 80 to bend around the user's head. Because the foam member 80 is attached to the shield 60, the shield 60, too, will bend around and conform to the user's head. This helps to ensure that the shield 60 will cover substantially all of the user's face.

Still looking to FIG. 15, the shield 60 may include a series of cuts 74 along the top edge 66 of the shield 60. The cuts 74 form a plurality of tabs 76 along the length of the top edge 66. As can be seen, these tabs 76 cover the openings 86 which helps prevent materials from entering the openings 86 and falling down into the user's face. The cuts 74 allow the tabs 76 to become articulated and to slightly overlap when the face shield 50 is engaged. As a result, the tabs 76 curve with the shield 60. Without the cuts 74, the portion of the shield 60 above the foam member 80 would either stand straight up or deform when the face shield 50 is engaged by a user.

Figure 16:
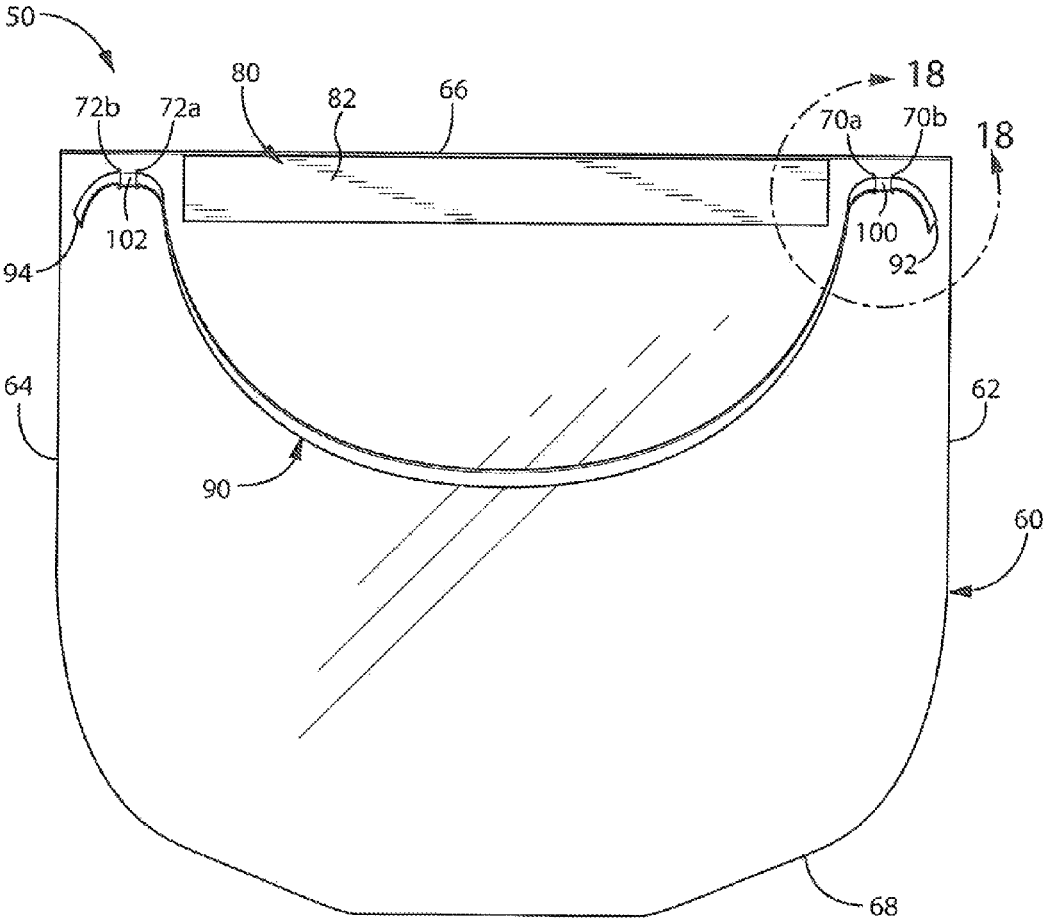
FIG. 16 is a front elevation view of the disposable face shield of FIG. 13.

Turning to FIG. 16, a front elevation view of the shield 50 is provided, wherein the shield 50 is again lying flat because the elastic strap 90 is not engaged. As can be seen, the front edge 82 of the foam member 80 is continuous because the openings 86 are recessed back into the foam member 80 between the front edge 82 and the back edge 84.

Figure 18:
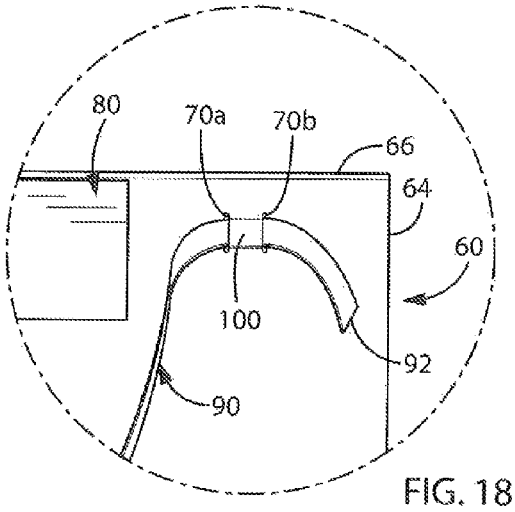
FIG. 18 is an enlarged view of reference line 18 of FIG. 16.

Still looking at FIG. 16, the shield 60 has a pair of parallel slits 70*a*, 70*b* adjacent to the first side edge 62 of the shield 60. A portion 100 of the plastic material of the shield 60 remains between the pair of parallel slits 70*a*, 70*b*. In fact, FIG. 18 provides a detailed view of this pair of parallel slits 70*a*, 70*b* and the interaction of the elastic strap 90. Turning back to FIG. 16, the shield 60 has a second pair of parallel slits 72*a*, 72*b* adjacent to the second side edge 64, also with a portion 102 of the plastic material of the shield 60 between. The slits 70*a*, 70*b*, 72*a*, 72*b* are configured such that an elastic strap can be threaded through the slits 70*a*, 70*b*, 72*a*, 72*b*. More specifically, the first end 92 of the elastic strap 90 is threaded first through slit 70*a* and then through 70*b*. The second end 94 of the elastic strap 90 is threaded first through slit 72*a* and then through 72*b*. Because of the close proximity between the parallel slits 70*a*, 70*b* and 72*a*, 72*b* and the portions of plastic material 100, 102 between the slits, the elastic strap 90 is held in place when the face shield 50 is in use. The elastic strap 90 can be adjusted by sliding either the first end 92 or the second end 94 of the strap 90 through either pair of slits 70*a*, 70*b* and 72*a*. 72*b*. Alternatively, the elastic strap 90 can also be attached to the shield 60 in other ways, for instance, by glue, fasteners, or other mechanical connections. Although two pairs of parallel slits is preferred, the elastic strap could alternatively be mechanically fastened or glued on one side of the shield 60 and adjustably engaged by one pair of parallel slits, either 70*a*, 70*b* or 72*a*, 72*b*.

Figure 17:
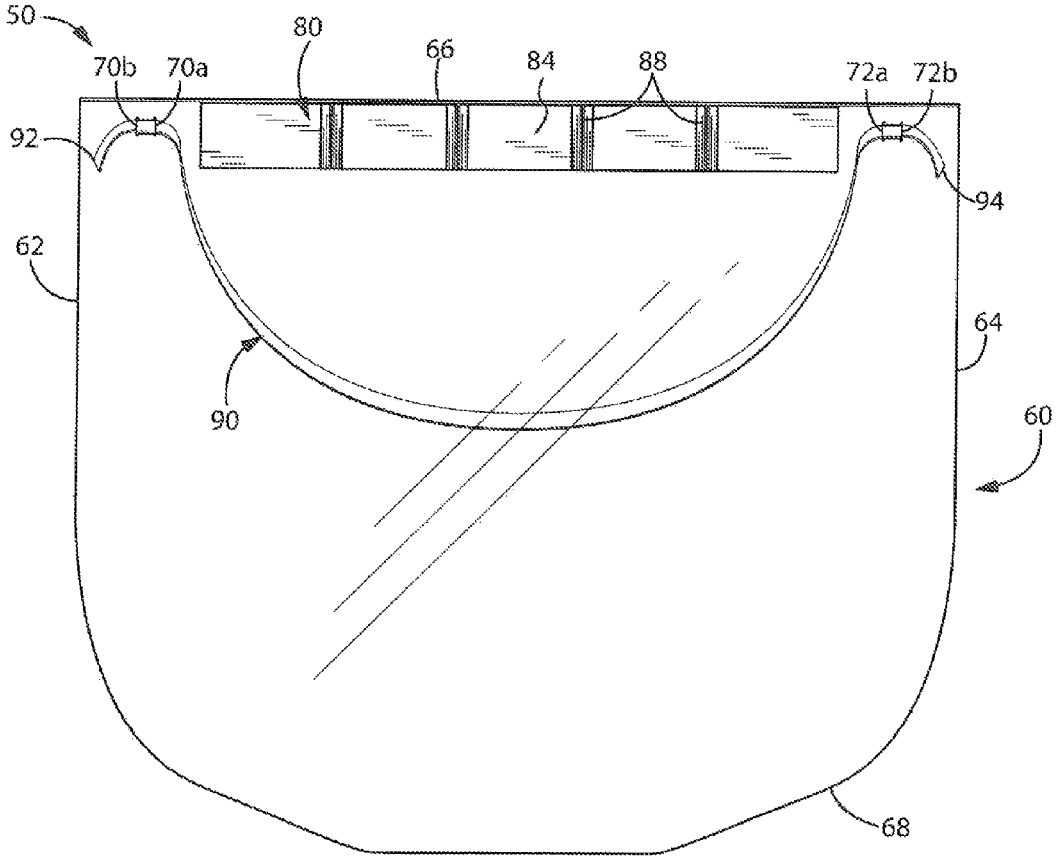
FIG. 17 is a rear elevation view of the disposable face shield of FIG. 13.

Looking next at FIG. 17, a reverse elevation view of the face shield 50 is provided where the shield 60 lies flat. Again, the two pairs of parallel slits 70*a*, 70*b*, 72*a*, 72*b* are illustrated. Additionally, the plurality of wedge cuts 88 along the back edge 84 of the foam member 80 is shown. These wedge cuts 86 are triangular in shape, which allows the foam member 80 to easily bend about the user's head.

Figure 19:
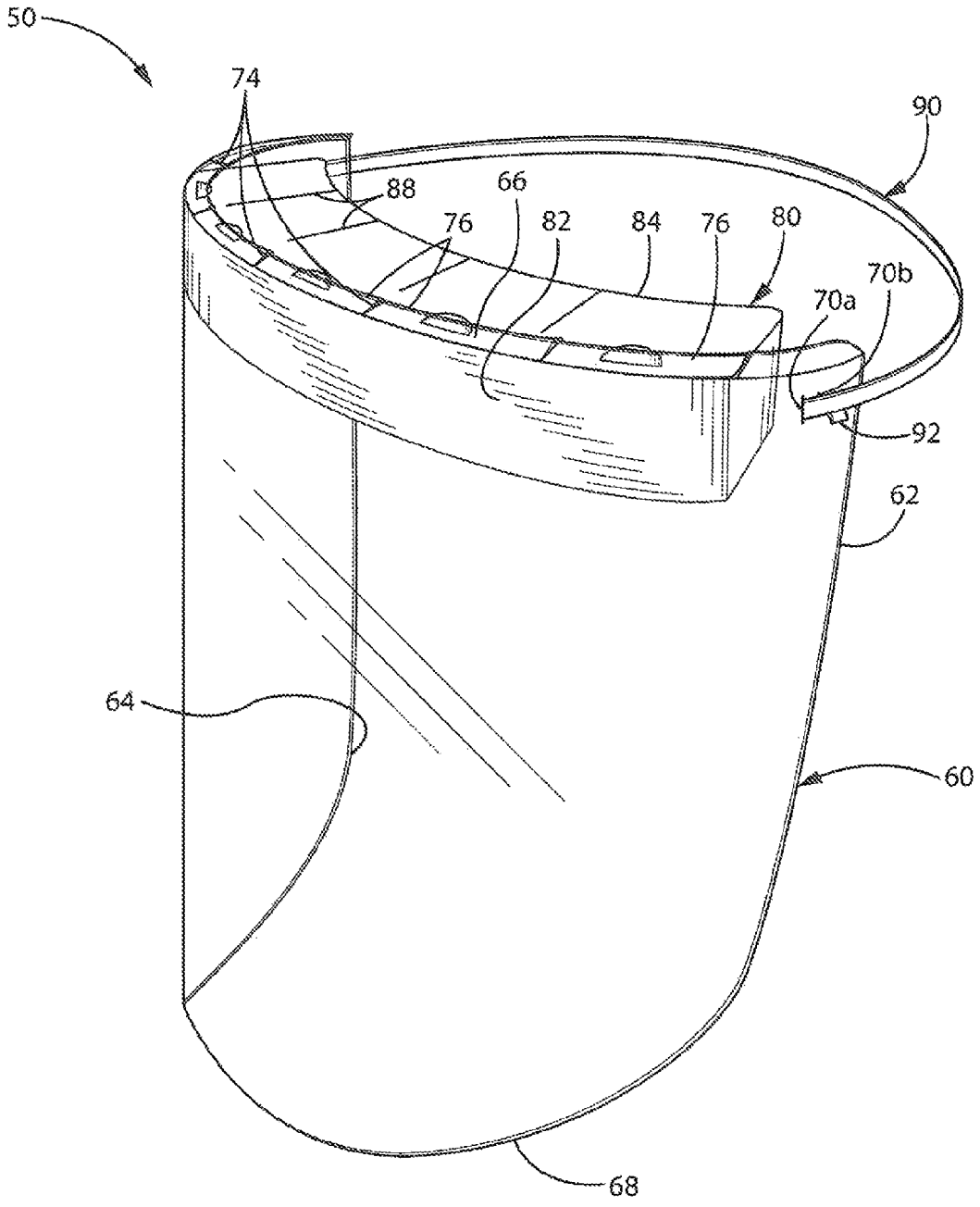
FIG. 19 is an isometric view of a disposable face shield with a foam pad with openings between the front edge and hack edge of the foam pad, wherein the shield has tabs bent to approximately 45 degrees to cover the openings.

FIG. 19 provides the face shield 50 in a flexed position there the shield 60 and the foam member 80 are curved. The shield 60 has a top edge 66, a first side edge 62, a second side edge 64, and a generally rounded bottom 68 that extend downward from the first side edge 62 and the second side edge 64. Along the top edge 66, the shield 60 has a plurality of cuts 74. The cuts 74 form a plurality of tabs 76 along the length of the top edge 66. These tabs 76 may be bent over to a 45-degree angle to substantially cover the openings 86 in the foam member 80. This helps prevent materials from entering the openings 86 and falling down into the user's face.

Again, the face shield 50 in FIG. 19 also has a foam member 80 with a continuous front edge. 82 that is mounted to the shield 60. The plurality of openings 86 is located in the thane member 80 between the front edge 82 of the foam member 80 and the back edge 84 of the foam member 80. The openings 86 provide air circulation around the face shield 50. This prevents fogging of the shield 60.

Figure 20:
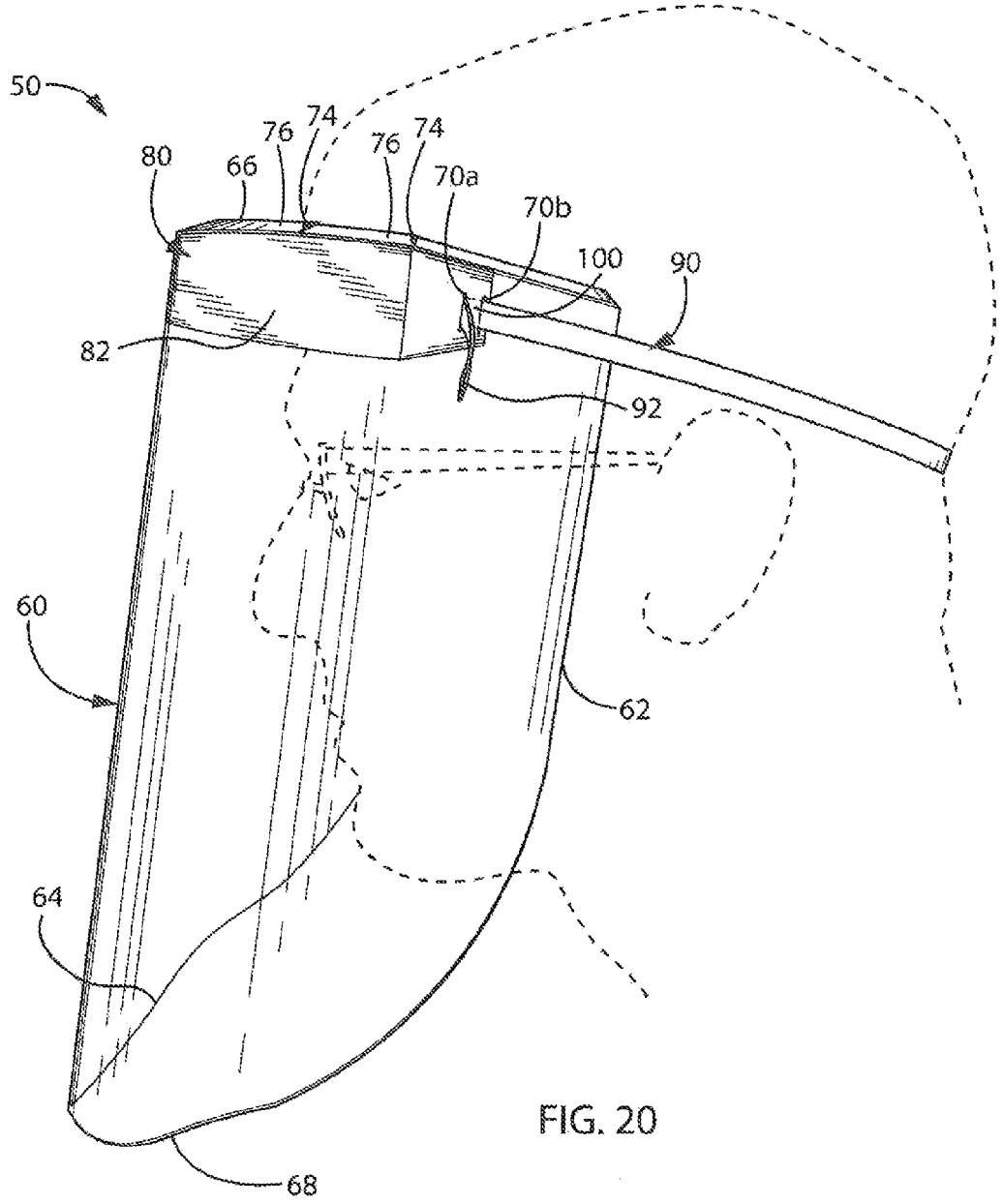
FIG. 20 is a side isometric view of the disposable face shield of FIG. 19.

Moving next to FIG. 20, the face shield 50 is shown in use from a side angle. For greater understanding, an outline of a user is provided. Again, the foam member 80 has a continuous front edge 82 that can be connected to the shield 60. The foam member has a plurality of openings 86 located between the front edge 82 and the back edge 84 of the foam member 80. The openings 86 increase the amount of air movement around the shield 60 and between the user's face and the shield 60.

Figure 21:
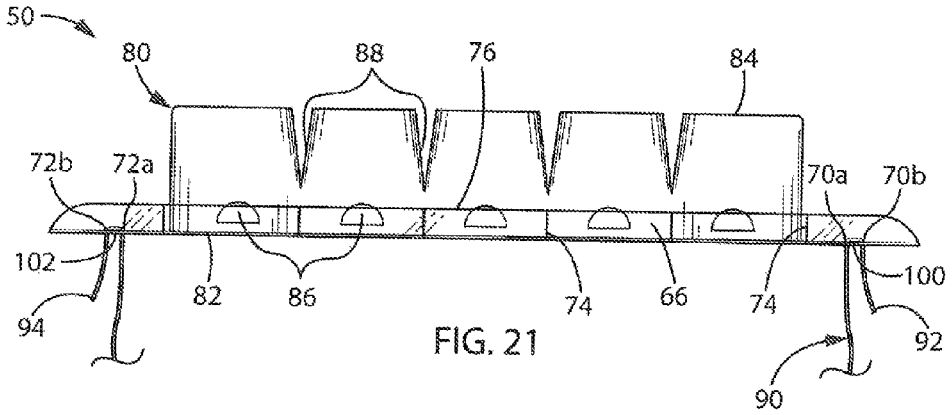
FIG. 21 is a top plan view of the disposable face shield of FIG. 19.

Moving now to FIG. 21, the face shield 50 is shown lying flat, which occurs when the elastic strap 90 is not engaged. This particular view of the face shield 50, shown from a top view, better illustrates the features of the foam member 80 attached to the shield 60. The plurality of openings 86 located in the foam member 80 increases the amount of air movement around the shield 60 and between the user's face and the shield 60. As shown, the openings 86 may be located between the front edge 82 of the foam member 80 and the back edge 84 of the foam member 80. Additionally, the foam member 80 may have a plurality of wedge cuts 88 along the back edge 84 of the member 80. For instance, the wedge cuts 88 may be triangular in shape. This shape of wedge cuts 88 allows the foam member 80 to bend around the user's head. Because the foam member 80 is attached to the shield 60, the shield 60 too will bend around and conform to the user's head.

Still looking to FIG. 21, the shield 60 may include a series of cuts 74 along the top edge 66 of the shield 60. The cuts 74 form a plurality of tabs 76 along the length of the top edge 66. As can be seen, these tabs 76 cover the openings 86 which helps prevent material from entering the openings 86 and falling down into the user's face. As can be seen, the tabs 76 line up but do not overlap one another when the shield 60 lies flat.

Figure 22:
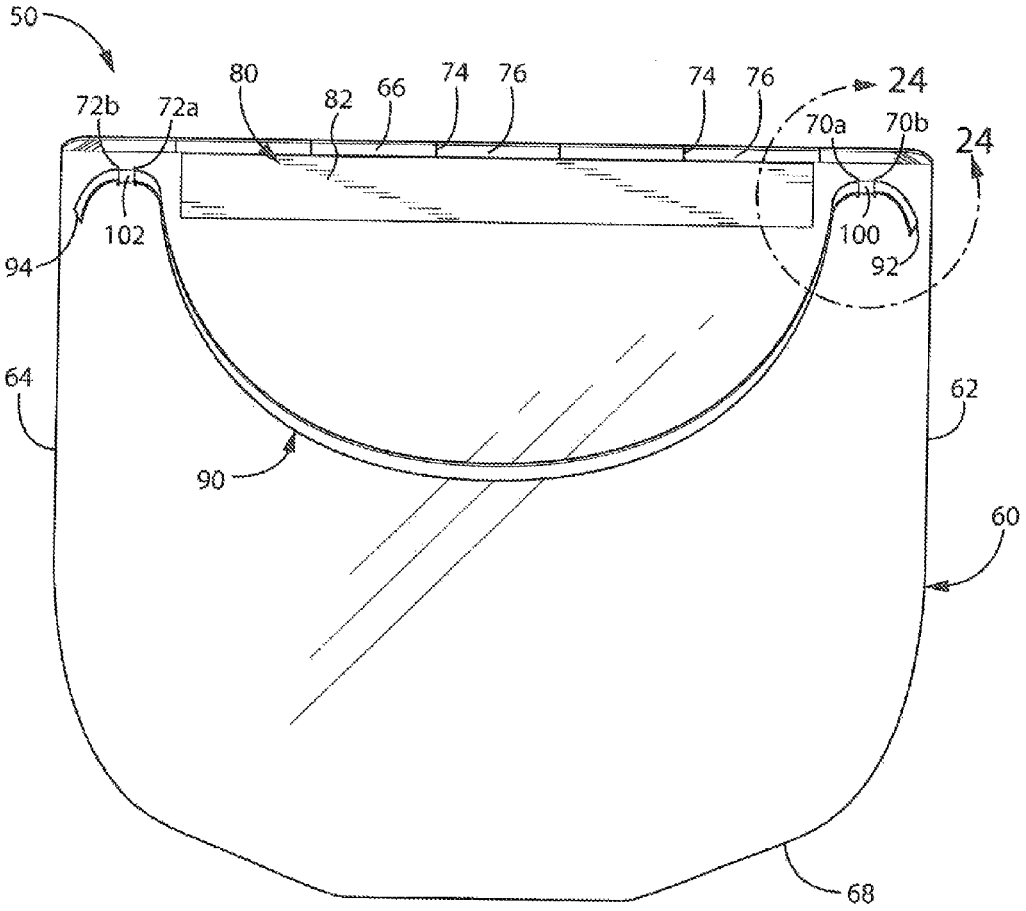
FIG. 22 is a front elevation view of the disposable face shield of FIG. 19.

Turning to FIG. 22, a front elevation view of the shield 50 is provided, wherein the shield 50 is again lying flat because the elastic strap 90 is not engaged. As can be seen, each of the tabs 76 is bent to a 45-degree angle. These tabs 76 substantially cover the plurality of openings 86 of the foam member 80. This in turn reduces the risk that harmful materials may enter through the plurality of openings 86. The cuts 74 allow the tabs 76 to become articulated and to slightly overlap when the face shield 50 is engaged. As a result, the tabs 76 curve with the shield 60. Without the cuts 74, the portion of the shield 60 above the foam member 80 would either stand straight up or deform when the face shield 50 is engaged by a user.

Figure 24:
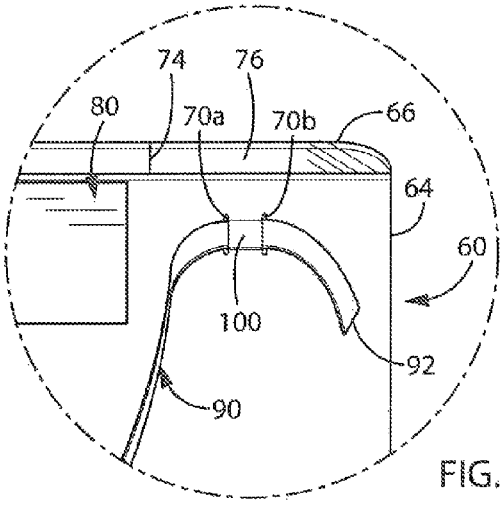
FIG. 24 is an enlarged view of reference line 24 of FIG. 22.

Still looking at FIG. 22, the shield 60 has a pair of parallel slits 70*a*, 70*b* adjacent to the first edge 62 of the shield 60. A portion 100 of the plastic material of the shield 60 remains between the pair of parallel slits 70*a*, 70*b*. In fact, FIG. 24 provides a detailed view of this pair of parallel slits 70*a*, 70*b* and the interaction of the elastic strap 90. Turning back to FIG. 22, the shield 60 has a second pair of parallel slits 72*a*, 72*b* adjacent to the second side edge 64, also with a portion 102 of the plastic material of the shield 60 between. The slits 70*a*, 70*b*, 72*a*, 72*b* are configured such that an elastic strap can be threaded through the slits 70*a*. 70*b*, 72*a*, 72*b*. More specifically, the first end 92 of the elastic strap 90 is threaded first through slit 70*a* and then through 70*b*. The second end 94 of the elastic strap 90 is threaded first through slit 72*a* and then through 72*b*. Because of the close proximity between the parallel slits 70*a*, 70*b* and 72*a*, 72*b* and the portions of plastic material 100, 102 between the slits, the elastic strap 90 is held in place when the face shield 50 is in use. The elastic strap 90 can be adjusted by sliding either the first end 92 or the second end 94 of the strap 90 through either pair of slits 70*a*, 70*b* and 72*a*, 72*b*.

Figure 23:
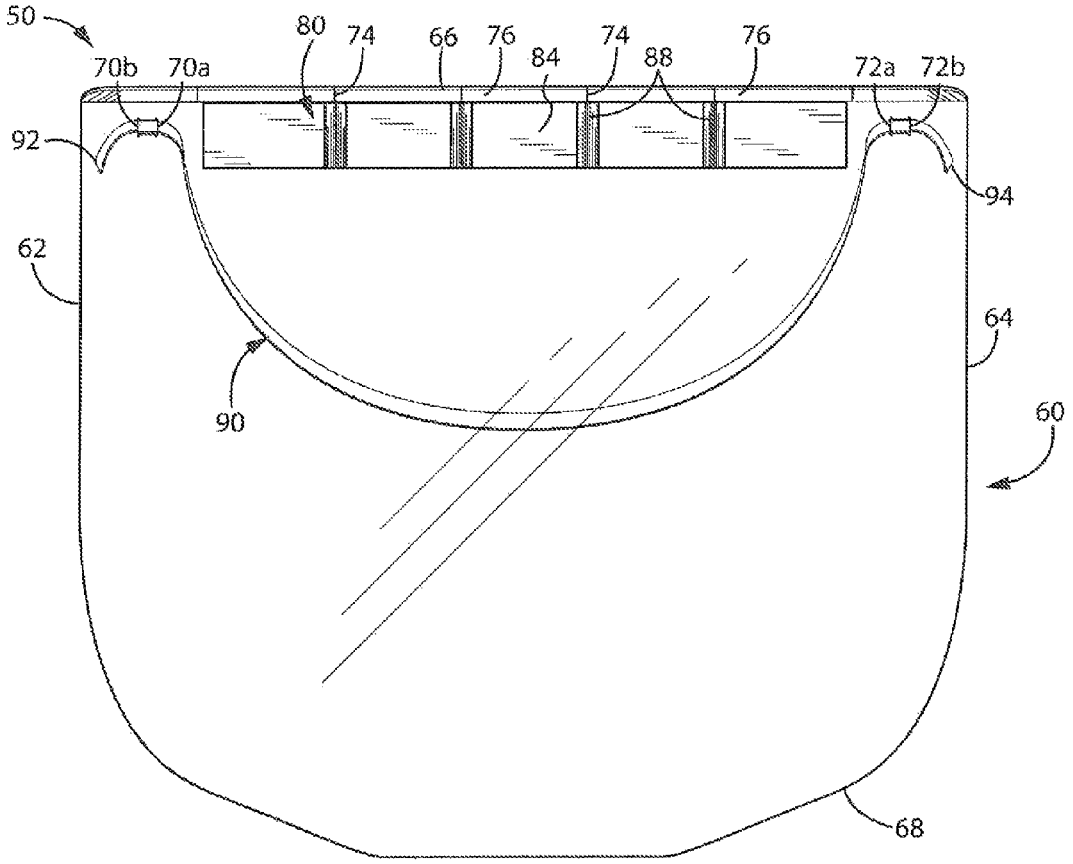
FIG. 23 is a rear elevation view of the disposable face shield of FIG. 19.

Looking next at FIG. 23, a reverse elevation view of the face shield 50 is provided where the shield 60 lies flat. Again, the two pairs of parallel slits 70*a*, 70*b*, 72*a*, 72*b* are illustrated. Additionally, the plurality of wedge cuts 88 along the back edge 84 of the foam member is shown. These wedge cuts 88 are triangular in shape, which allows the foam member 80 to easily bend about the user's head.

Figure 25:
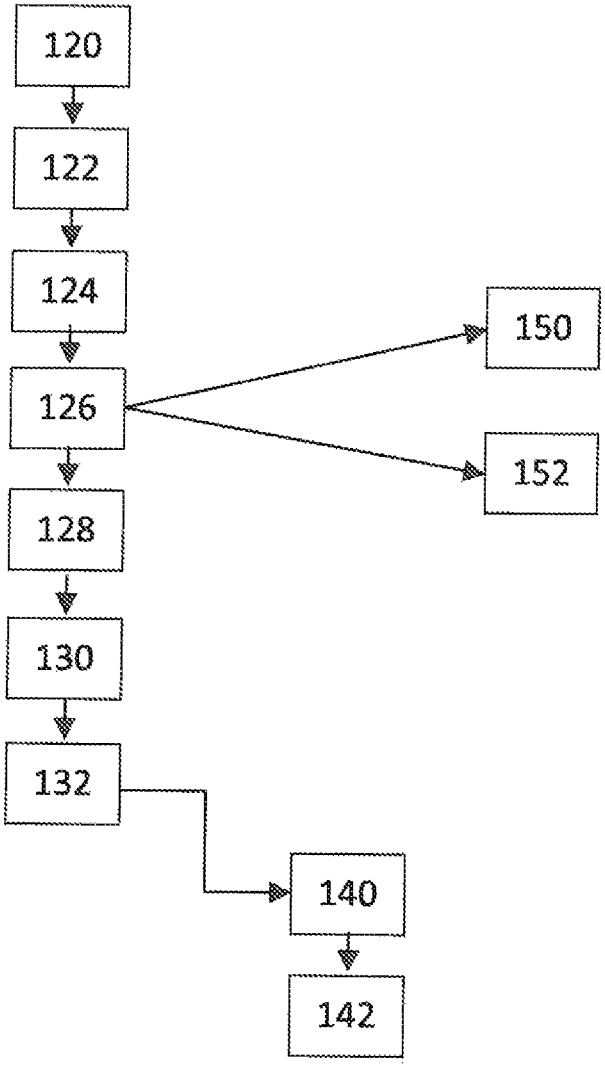
FIG. 25 is a flow chart of the method of assembling a face shield.

Additionally, a method of assembling the face shield 50 is provided in FIG. 25. First, a sheet of transparent plastic material is cut into a shield that covers a user's face 120. Next, a pair of slits is cut into the plastic material adjacent to a first edge of the shield 122. After that, a second pair of slits is cut into the plastic material on a second edge of the shield opposite the first 124. A foam member with a plurality of openings is then attached to the shield between the first pair of slits and the second pair of slits 126. The plurality of openings may be formed along a front edge of the foam member, which results in the openings abutting the shield 150. Also, the plurality of openings may be formed between the front edge of the foam member and the back edge of the foam member, which results in the openings being recessed from the shield 152. Next, an elastic strap is threaded through the first pair of slits 128. The opposite end of the elastic strap is then threaded through the second pair of slits 130. The elastic strap is then adjusted so that the shield fits comfortably around a user's head 132. Additionally, a plurality of tabs may be formed along a top edge of the shield above the foam member 140. The tabs can then be bent to provide partial coverage of the openings 142.

Although the best mode contemplated by the inventors of carrying out the present invention is disclosed above, practice of the present invention is not limited thereto. It will be manifest that various additions, modifications, and rearrangements of the features of the present invention may be made without deviating from the spirit and scope of the underlying inventive concept.

For example, the face shield could be enhanced by providing additional features that add to a user's overall comfort. For instance, foam members with different configurations could be used based on the preference of the user. Additionally, the face shield could feature a hinged or flipped design that would allow the shield to be rotated out of the user's filer when not needed. Similarly, although polyester is the preferred material for the shield, any material could be used in its place. In addition, the individual components need not be fabricated from the disclosed materials, but could be fabricated from virtually any suitable materials.

Moreover, the individual components need not be formed in the disclosed shapes or assembled in the disclosed configuration, but could be provided in virtually any shape and assembled in virtually any configuration so as to provide a customizable face shield. For instance, different sized shields could be used, including a shield that does not cover the user's mouth and nose but covers the user's eyes. Furthermore, all the disclosed features of each disclosed embodiment can be combined with, or substituted for, the disclosed features of every other disclosed embodiment except where such features are mutually exclusive.

It is intended that the appended claims cover all such additions, modifications and rearrangements. Expedient embodiments of the present invention are differentiated by the appended claims.

What is claimed is:

1. A face shield assembly comprising:

a flexible transparent shield generally configured to cover a user's face, the shield having a top edge, a first side edge, a second side edge, a bottom edge, and a plurality of vertical cuts that are generally parallel where a portion of the shield is located between the cuts;

a foam member attached to the shield adjacent to the top edge of the shield;

a plurality of openings extending through the foam member; and an elastic hand attached to the shield;

wherein the plurality of cuts is located along the top edge of the face shield above the foam member, and wherein the portion of the shield located between the cuts form tabs that partially cover the plurality of openings.

2. The face shield assembly of claim 1, wherein the tabs become articulated and overlap one another when the face shield assembly is in use.

3. The face shield assembly of claim 2, wherein the plurality of openings is located along a front edge of the foam member.

4. The face shield assembly of claim 2, wherein the plurality of openings is located between a front edge of the foam member and a back edge of the foam member, and wherein the plurality of openings do not extend through the front edge of the foam member and the plurality of openings do not extend through the back edge of the foam member.

5. The face shield assembly of claim 2, wherein the plurality of openings is semi-circular in shape.

6. The face shield assembly of claim 1, wherein the foam member has a plurality of wedge cuts that allow curvature of the foam member about the user's face.

7. A method of assembling a face shield assembly comprising the steps of:

cutting a sheet of transparent plastic material into a shield that covers a user's face;

cutting a first slit and a second slit that is parallel to the first slit adjacent to a first side edge of the shield;

cutting a third slit and a forth slit that is parallel to the third slit adjacent a second side edge of the shield;

attaching a foam member to the shield between the first pair of slits and the second pair of slits, the foam member having a plurality of openings;

threading a first end of an elastic strap through the first slit and second slit, where the first end of the elastic strap binds itself and resists movement when put in tension due to the first slit and second slit;

threading a second end of the elastic strap through the third slit and fourth slit, where the second end of the elastic strap binds itself and resists movement when put intension due to the third slit and the fourth slit;

adjusting the elastic strap so that the shield fits comfortably around a user's head;

forming a plurality of tabs along a top edge of the shield above the foam member; and bending the tabs to provide partial coverage of the plurality of openings.

8. The method of claim 7 further comprising the step of forming the plurality of openings in the foam member along a front edge of the loam member, such that the plurality of openings abuts the shield.

9. The method of claim 7, further comprising the step of forming the plurality of openings in the foam member between a front edge of the foam member and a back edge of the foam member, such that the openings are offset from the front edge and the hack edge.

10. A face shield assembly comprising:

a flexible transparent shield with a plurality of tabs along a top edge;

a foam member with a plurality of holes extending therethrough attached to the shield below the tabs; and an elastic strap that is adjustably attached to the flexible shield;

wherein the plurality of tabs partially cover the plurality of holes;

and wherein the plurality of holes facilitate air movement around the face shield.

11. The face shield assembly of claim 10, wherein the shield has a first pair of parallel slits along a first side edge and a second pair of parallel slits along a second side edge.

12. The face shield assembly of claim 11, wherein the elastic strap slides through the first pair of parallel slits and the second pair of parallel slits.

13. The face shield assembly of claim 12, wherein the first pair of parallel slits and the second pair of parallel slits are concentric about a vertical line extending through a center point of the shield.

14. The face shield assembly of claim 10, wherein the plurality of holes is located along a front edge of the foam member that abuts the face shield.

15. The face shield assembly of claim 10, wherein the holes are offset from a front edge of the foam member and a back edge of the foam member.

16. The face shield assembly of claim 10, wherein the foam member has a plurality of wedge cuts along a back edge of the foam member.

17. The face shield assembly of claim 16, wherein the back edge of the foam members conforms to a user's forehead.

* * * * *